US009132688B2

(12) United States Patent
Ota et al.

(10) Patent No.: US 9,132,688 B2
(45) **Date of Patent: *Sep. 15, 2015**

(54) BOOKBINDING UNIT

(75) Inventors: Seiichi Ota, Minamikoma-gun (JP); Kazuyuki Kubota, Minamikoma-gun (JP); Takehiro Yamakawa, Minamitsuru-gun (JP)

(73) Assignee: Nisca Corporation, Minamikoma-gun (JP)

( * ) Notice: Subject to any disclaimer, the term of this patent is extended or adjusted under 35 U.S.C. 154(b) by 1993 days.

This patent is subject to a terminal disclaimer.

(21) Appl. No.: 12/234,861

(22) Filed: Sep. 22, 2008

(65) Prior Publication Data

US 2009/0081001 A1 Mar. 26, 2009

(30) Foreign Application Priority Data

Sep. 20, 2007 (JP) ..... 2007-244304

(51) Int. Cl.
*B42C 11/04* (2006.01)
*B42C 9/00* (2006.01)

(52) U.S. Cl.
CPC ..... *B42C 11/04* (2013.01); *B42C 9/0006* (2013.01)

(58) Field of Classification Search
CPC ..... B42C 11/00; B42C 9/0006
USPC ..... 412/4, 12, 37, 11, 19, 6, 8
See application file for complete search history.

(56) References Cited

U.S. PATENT DOCUMENTS

| | | | | |
|---|---|---|---|---|
| 6,685,416 | B2 * | 2/2004 | Itoh et al. | 412/37 |
| 2007/0001362 | A1 * | 1/2007 | Tsukui et al. | 270/58.12 |
| 2007/0122256 | A1 * | 5/2007 | Toyoizumi et al. | 412/37 |

FOREIGN PATENT DOCUMENTS

| | | | |
|---|---|---|---|
| JP | 2003-025759 | A | 1/2003 |
| JP | 2005-305822 | A | 11/2005 |

* cited by examiner

*Primary Examiner* — Shelley Self
*Assistant Examiner* — Matthew G Katcoff
(74) *Attorney, Agent, or Firm* — James W. Judge

(57) ABSTRACT

Bookbinding unit eliminating the necessity of a user, in placing collated inner leaves onto a tray, pre-measuring the bundle thickness, and the danger of fingers getting pinched during the placement. Furnished with: inner-leaf tray; coversheet tray; gripping conveyor gripping and transporting bundles of leaf-tray sheets; coversheet conveyor feeding coversheet-tray covers and placing them in a binding location; adhesive applicator applying adhesive to bundle spine-portion endfaces; cover binder binding bundles and covers together; and controller encasing bundles in covers to form booklets. A first detector, in the inner-leaf tray, detects thickness of bundles therein, and a second detector, in the gripping conveyor, detects thickness of the gripped bundles. The controller prohibits the gripping conveyor from conveying inner leaves out from the inner-leaf tray when the thickness of a sheet bundle detected by the first detector is more than a predetermined thickness.

6 Claims, 13 Drawing Sheets

BOOKBINDING UNIT

BACKGROUND OF THE INVENTION

1. Technical Field

The present invention—involving bookbinding units that form encased booklets by binding into coversheets inner-leaf sheets that have been collated into bundles—relates to improvements in control schemes for controlling bookbinding processes according to sheet-bundle thickness.

2. Description of the Related Art

Bookbinding units that in general collate into bundles sheets that have been printed in a digital printer or other printing machine and encase the bundles in coversheets to form booklets are widely known. With this scheme, inner-leaf sheets collated into a sheet bundle are set into a stack on an inner-leaf tray, and the bundled sheets are conveyed from the tray to an adhesive-application location, and an adhesive (such as a hot-melt adhesive) is applied to a spine-portion endface of the sheets. Meanwhile, a coversheet from a coversheet tray is fed to, and set into place at, a cover-binding location arranged downstream of the adhesive-application location; the spine portion of the inner-leaf sheets, where the adhesive has been applied, is joined to a cover-binding portion of the coversheet in its middle; and thereafter the coversheet is spine-creased and molded in a coversheet pressing means.

Conventionally, as disclosed in Japanese Unexamined Pat. App. Pub. No. 2003-025759, an inner-leaf tray is disposed on one end of the unit, and a cover tray is disposed on the other end. The inner-leaf tray stores collated and stacked inner-leaf sheets (bundles), and the coversheet tray stores a plurality of coversheets of predetermined sizes. The inner-leaf sheets are conveyed in bundle form to a bookbinding processing stage (cover-binding location) situated in the mid-portion of the device, and from the tray the coversheets are conveyed separated into single sheets. To the upstream side of the coversheet binding stage, adhesive tape (or a hot-melt adhesive) is attached to the spine-portion endface of the inner-leaf sheets. In addition, the coversheet binding stage is fitted out with spine-folding press members. Conventional bookbinding units of this sort are known to suffer from the device requiring scaled-up installation space in that, for example, as disclosed in the cited reference, the inner-leaf sheets in bundle form are conveyed with a conveyor mechanism from a sheet supply unit to the bookbinding processing stage. Furthermore, when the three sides (the head, foot and fore-edge portions) of a sheet bundle in booklet form that has been book-forming processed in a bookbinding unit of this sort are trimmed true, the bookbinding unit is equipped with a trimming device that is distinct from the unit, and the trim-finishing is carried out in the trimming device.

Meanwhile, the present applicants have proposed, in Japanese Unexamined Pat. App. Pub. No. 2005-305822 and elsewhere, a unit that continuously bookbinding-processes image-bearing sheets from an image-forming unit. In the publication, a unit is proposed wherein sheets printed with images are collated and stacked in a bookbinding unit connected to a discharge outlet of an image-forming unit. These inner-leaf sheets are conveyed to an adhesive application position by a gripping conveyance means. There a spine portion of the sheet bundle is coated with adhesive. A coversheet is fed from a cover path that is different from the conveyance path for the inner-leaf sheets and set into place in a cover-binding location.

In bookbinding units like that just described, the thickness of the bundle along the spine portion that is bookbinding processed must be detected. For the unit in Japanese Unexamined Pat. App. Pub. No. 2003-025759, a bundle-thickness detection mechanism is disclosed wherein the inner-leaf sheets (text block) are set in a clamping mechanism furnished with a sheet-supply tray, and the bundle thickness of sheets gripped in the clamping mechanism is detected. The unit is configured to place into the binding location a coversheet corresponding to the bundle thickness sensed by the detection mechanism.

Japanese Unexamined Pat. App. Pub. No. 2005-305822 discloses adjusting the application of adhesive by increasing/decreasing the amount based on sheet-bundle thickness information, yet in what way sheet-bundle thickness is detected is not disclosed. In particular, the application amount is modulated by regulating the gap between the sheet bundle and applicator roller based on the thickness information.

As just described, in bookbinding units that form encased booklets by binding inner-leaf sheet bundles in coversheets, detecting the thickness of the inner-leaf sheet bundles and adjusting the adhesive application amount based on the thickness information is known, as is adjusting the position of the coversheets fed to and set into place in the binding location. Such implementations—with a unit configuration, as in the earlier cited Pub. No. 2003-025759, in which the thickness of inner-leaf sheets having been collated onto a tray is detected with the bundle being clamped in a clamping mechanism, and the bundle-thickness information is thereafter employed in the bookbinding processes—carry with them the following problems.

By adopting the structure of the earlier cited reference, in which a clamping mechanism is disposed in the tray where the user sets the sheet bundle to detect the thickness of the sheet bundle, to set the adhesive application amount and coversheet position orientation based the detected thickness, the clamping mechanism cannot accurately detect the sheet bundle thickness if the sheet bundle is not gripped with adequate pressure. The adhesive amount is inaccurate or the coversheet will be displaced if the thickness of the sheet bundle is detected when the clamping mechanism grips the sheet bundle with a weak gripping force. In either case, the quality of the finished booklet will be negatively affected.

When a clamping mechanism is disposed on the tray and a strong pressure is used to the press the sheet bundle, problems occur with users getting their fingers caught in the damper mechanism when setting the sheet bundle on the tray, or the clamping mechanism being damaged if foreign matter enters the tray at the same time as the sheet bundle.

Therefore, when setting the control conditions of the subsequent bookbinding process by detecting the thickness of the sheet bundle, for safety reasons it is preferable that the bundle-thickness detection means be disposed in the unit in a position other than the tray where the inner-leaf sheets are set. However, by disposing this clamping mechanism that detects the sheet bundle thickness inside the unit, new problems arise.

When sheets of a sheet bundle that cannot be clamped are set on the tray, the sheet bundle is conveyed to the clamping mechanism in the unit and the excess sheets can become scattered in the machine. For example, if the preset thickness of the booklet is 50 sheets, and the user mistakenly sets more than 50 sheets on the tray, a jam can occur at the clamping mechanism, and the excess sheets can become scattered.

BRIEF SUMMARY OF THE INVENTION

The inventors had the idea of providing in the tray where the inner-leaf sheets are set detection means for a primary detection of the thickness of the sheet bundle, and conveying the sheet bundle on the tray if it is possible to accurately grip the sheets using the clamping mechanism. Then, by providing detection means on the clamping mechanism disposed downstream of the tray for detecting the sheet bundle thickness to set the control conditions of the bookbinding process, the problems described above can be solved.

An object of the present invention is to provide a bookbinding unit that does not require the user to measure the thickness of the sheet bundle in advance and has no danger of the user's fingers getting caught in the mechanism when setting sheets. The present invention also provides a bookbinding unit that feeds the sheet bundle into the unit and does not cause errors such as jams when an excessive amount of sheets are placed on the tray.

In order to attain the aforementioned objects, the present invention provides a first bundle-thickness detection means in an inner-leaf tray that stacks sheets collated into a sheet bundle, and a second bundle-thickness detection means in gripping conveyance means for conveying the sheet bundle from the tray to the predetermined adhesive application position. This makes it possible to adopt a simple detection structure for the first bundle-thickness detection means it is possible to determine the sheet bundle thickness by gripping the sheet bundle with the gripping conveyance means, and by adopting a detection structure for the second bundle-thickness detection means it is possible to set the control conditions for the bookbinding processes.

The present invention features the following configuration. The bookbinding unit that encases in a coversheet inner sheets collated into a bundle has an inner-leaf tray that sets the inner sheets in bundles and a coversheet tray that sets coversheets and is equipped with a bookbinding path that guides the sheet bundle from the inner-leaf tray to an adhesive application position and a coversheet binding position; gripping conveyance means for feeding the sheet bundle from the inner-leaf tray along the bookbinding path; coversheet conveyance means for feeding the coversheet from the coversheet tray to the coversheet binding position; adhesive application means disposed in an adhesive application position for applying adhesive to a spine edge portion of inner sheets; cover binding means disposed in the coversheet binding position for binding the inner sheets and coversheet; and bookbinding operation control means for the bookbinding process of the inner sheets and coversheets. The first bundle-thickness detection means is disposed in the inner-leaf tray to detect the thickness of the stacked sheet bundle and the second bundle-thickness detection means is disposed in the gripping conveyance means to detect the thickness of the gripped sheet bundle. The bookbinding operation control means prohibits the conveyance of the inner sheets from the inner-leaf tray by the gripping conveyance means when the thickness of the sheets detected by the first bundle-thickness detection means exceeds a predetermined thickness, and controls the adhesive application means and/or the coversheet conveyance means based on the thickness information from the second bundle-thickness detection means.

The bookbinding operation control means determines whether the sheet bundle thickness detected by the first bundle-thickness detection means is beyond the maximum permissible thickness that can be conveyed by the gripping conveyance means when the conveyance of the sheet bundle is prohibited from the inner-leaf tray by the gripping conveyance means.

Trimming means is disposed downstream of the cover binding means to trim true edges of a bound sheet bundle; the bookbinding operation control means varies the trimming speed of the trimming means and/or the trimming blade moving amount based on the sheet bundle configuration information from the second bundle-thickness detection means.

The bookbinding operation control means has coversheet position computing means that calculates the position to set the coversheet fed to the coversheet binding position by the coversheet conveyance means, based on the sheet bundle information from the second bundle-thickness detection means.

The bookbinding operation control means controls the adhesive application amount to increase or decrease the adhesive amount using the adhesive application means and/or the gripping conveyance means based on the sheet bundle thickness information from the second bundle-thickness detection means.

The first bundle-thickness detection means is composed of a sheet contact arm that touches the uppermost sheet stacked in the inner-leaf tray, and a sensor that detects the amount of movement of the sheet contact arm.

The present invention attains the following effects because the first bundle-thickness detection means is disposed in the inner-leaf tray where inner-leaf sheets collated into sheet bundle, and the second bundle-thickness detection means is disposed in the gripping conveyance means that conveys the sheet bundle from the tray, and because the conveyance of the sheet bundle by the gripping conveyance means when the sheet bundle detected by the first bundle-thickness detection means is thicker than the predetermined thickness, and executes the bookbinding operations based on the thickness information from the second bundle-thickness detection means.

The first bundle-thickness detection means disposed in the inner-leaf tray adopts a simple thickness detection structure to a degree (a rough detection) to determine whether it is possible to grip the sheet bundle using the gripping conveyance means, and there is no danger of the user getting his finger caught when setting sheets. At the same time, because an excessively thick sheet bundle is not conveyed by the gripping conveyance means so there are not erroneous operations such as jams, or unit malfunctions.

Because settings are made for control conditions such as the adhesive application amount, coversheet positioning and coversheet binding process and the like, based on the sheet bundle thickness from the second bundle-thickness detection means disposed in the gripping conveyance means, the bookbinding process can be performed accurately by this detection means adopting a detection mechanism that attains an accurate detection.

Furthermore, the present invention has the notable effect of being able to quickly and accurately trim edges of the sheet bundle because it is equipped with trimming means downstream of the coversheet binding position to trim true edges of a sheet bundle bound to a coversheet, adjusts the trimming speed according to the sheet bundle thickness information from the second bundle-thickness detection means and the movement amount (movement stroke) of the trimming blade.

BRIEF DESCRIPTION OF THE SEVERAL VIEWS OF THE DRAWINGS

FIG. 5A shows an outward movement state of adhesive container; FIG. 5B shows a return movement of the adhesive container; FIG. 5C is a sectional view of FIG. 5A; FIG. 5D is a sectional view of FIG. 5B;

FIG. 7A shows the status of applying adhesive; FIG. 7B, C, D show the configuration of the sheet bundle;

FIG. 9A is an explanatory view of a state to set sheets in an inner-leaf tray; FIG. 9B shows a configuration of a first bundle thickness detection means disposed in the inner-leaf tray;

DETAILED DESCRIPTION OF THE INVENTION

Figure 1:
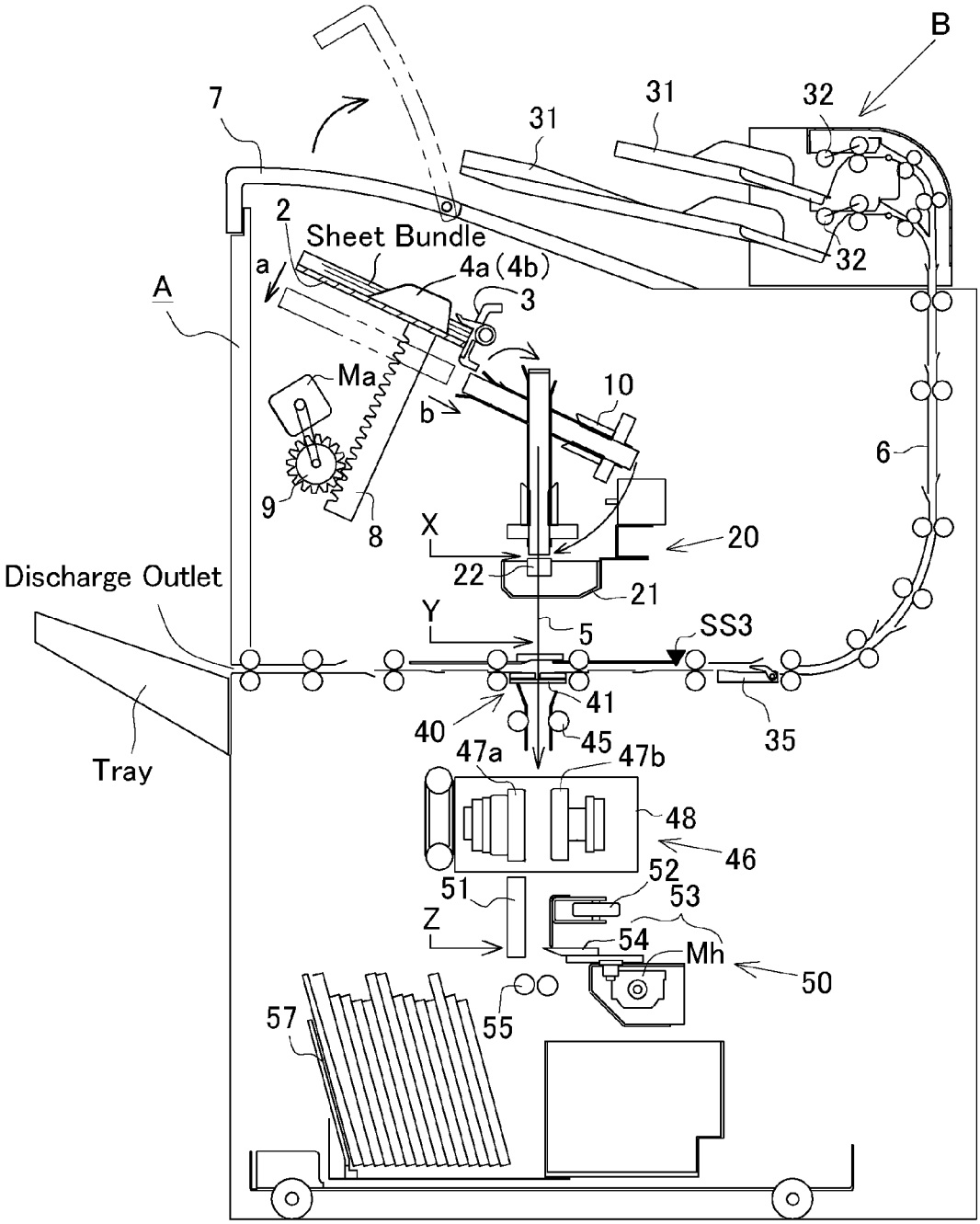
FIG. 1 is an overall view of a bookbinding unit of the present invention.
Figure 2:
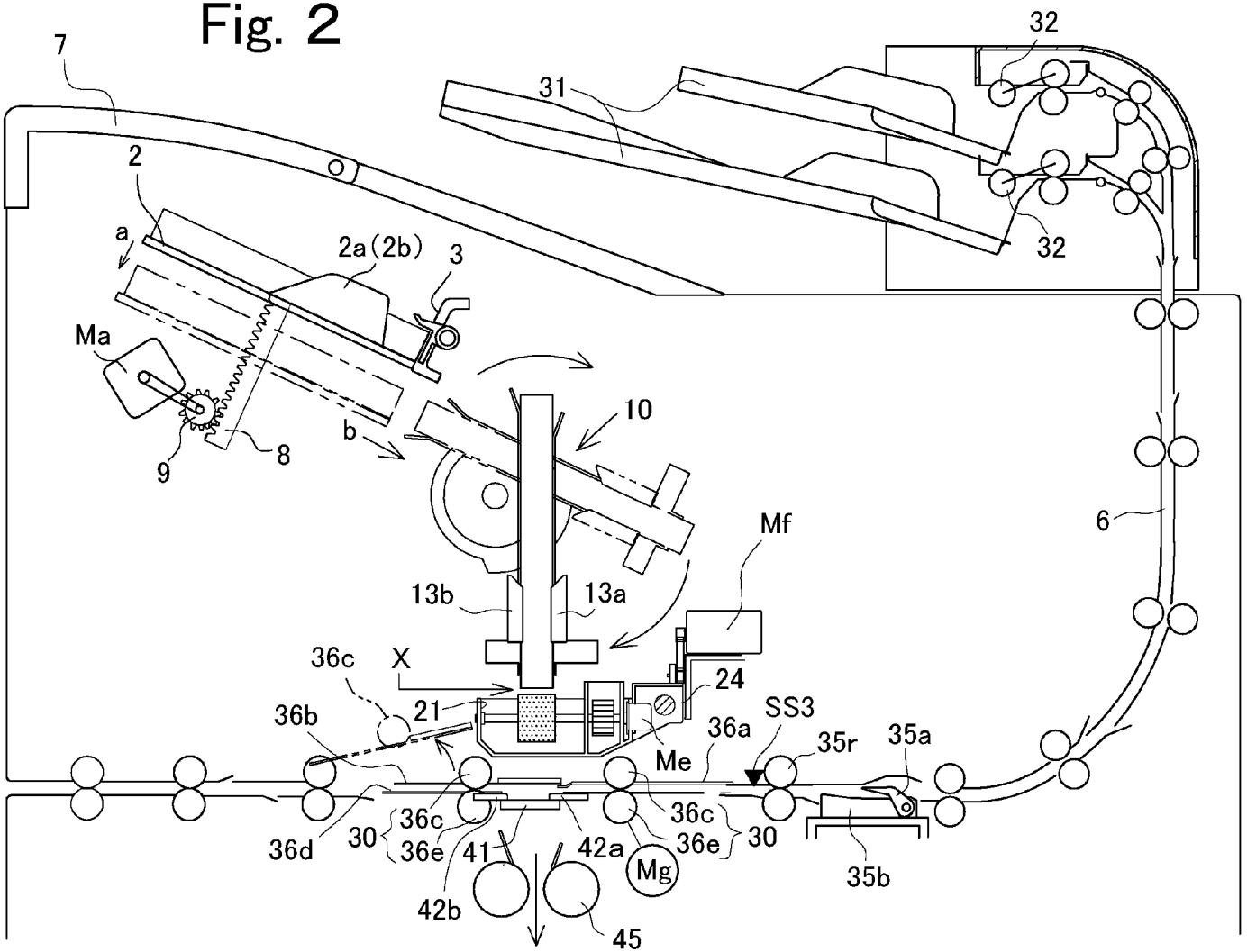
FIG. 2 is an expanded explanatory view of the bookbinding unit in the unit shown in FIG. 1.

Preferred embodiments of the present invention will now be explained with reference to the drawings provided. FIG. 1 is an explanatory view of the overall configuration of the bookbinding unit according to the present invention; and FIG. 2 is an expanded view of an essential portion thereof.

The present invention relates to a bookbinding unit A that applies hot-melt adhesive such as glue, or adhesive tape to a spine edge surface of a sheet bundle (inner-leaf sheets) set in a predetermined tray (inner-leaf tray 2) and encases the sheet bundle in a coversheet conveyed from a coversheet tray 31. The bookbinding unit A shown in FIG. 1 is composed of the inner-leaf tray 2 that stores inner-leaf sheets that have been collated into a sheet bundle; adhesive application means 20 that apply adhesive to a spine-portion endface of the sheet bundle conveyed from the tray; coversheet conveyance means 30 that convey to and set a coversheet at the cover-binding location Y; and cover binding means 40 disposed at the cover-binding location. An adhesive application position (hereinafter referred to as the application position) X, a cover-binding location (hereinafter referred to as the binding position) Y, and trimming position Z are disposed in this order in the bookbinding process path (hereinafter referred to as the bookbinding path) 5. Trimming means 50 that trims true three sides of the sheet bundle covered by the coversheet are disposed in the trimming position Z. The configuration of each of these will now be explained.

Inner-Leaf Tray Configuration

The inner-leaf tray 2 disposed in the bookbinding path 5 is composed of a tray that stacks sheets in a bundle; the tray shown in the drawing is substantially horizontally oriented. A trailing edge aligning member 3 that aligns the position of the trailing edge of the sheet and side guides 4*a*, 4*b* that align the positions of the sheet sides are provided in the inner-leaf tray 2. It is acceptable for the inner-leaf tray 2 to be fastened to the apparatus frame. However, the drawing shows the tray attached to the apparatus frame to move in up and down directions between a stacking position and a conveyance out position of FIG. 1. As shown in FIG. 2, a gear rack 8 established on a bottom portion of the tray 2 is mated to a pinion 9 of a tray elevator motor Ma. The forward and reverse drives of the tray elevator motor Ma raise and lower the inner-leaf tray 2 between the stacking position (solid lines in FIG. 1) and the conveyance out position (dashed lines in FIG. 1). Therefore, sheets stacked on the inner-leaf tray 2 are lowered in the direction of the arrow a from the stacking position, then are moved in the direction of the arrow b to be transferred to the inner-leaf conveyance means (gripping conveyance means) 10. Note that the symbol 7 in the drawing denotes an opening cover of the inner-leaf tray 2; the cover is openably linked to the apparatus casing by a hinge.

Configuration of Inner-Leaf Width Detection Means

Figure 10:
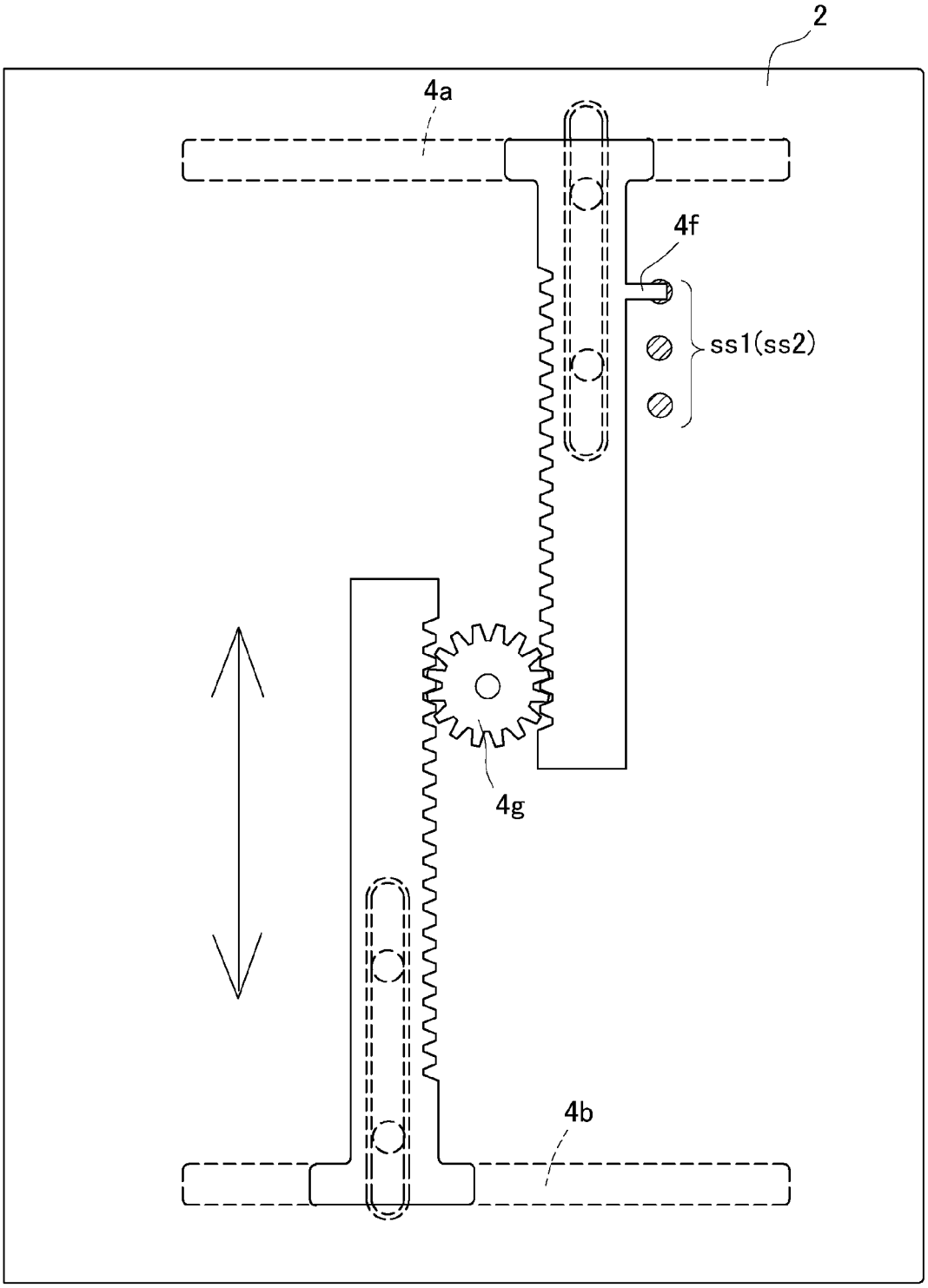
FIG. 10 is an explanatory view of a configuration of sheet width size detection means on the inner-leaf tray and coversheet tray in the unit shown in FIG. 1.

The side guides 4*a*, 4*b* are composed of one or a pair of guide members to align sheets to a side or a center reference. The inner-leaf sheet width size detection means SS1 is disposed on the side guides 4*a*, 4*b* shown in the drawing to detect the width size of aligned sheets. The configuration is shown in FIG. 10. The right side guide 4*a* and left side guide 4*b* disposed on the top surface of the tray are connected by an interlock gear 4*g* to mutually approach and separate from each other the same amount. A flag 4*f* is provided on one of the side guides 4*a* to detect its position. Positions of the flag 4*f* are detected by a plurality of sensor arrays SS1 to identify the inner-leaf sheet width size. Note that when using a side reference, it is acceptable to align the position of the sheets using one side guide and detect an opposite side edge of sheets aligned to position with this guide directly with a sensor.

Configuration of First Bundle Thickness Detection Means

Figure 9A:
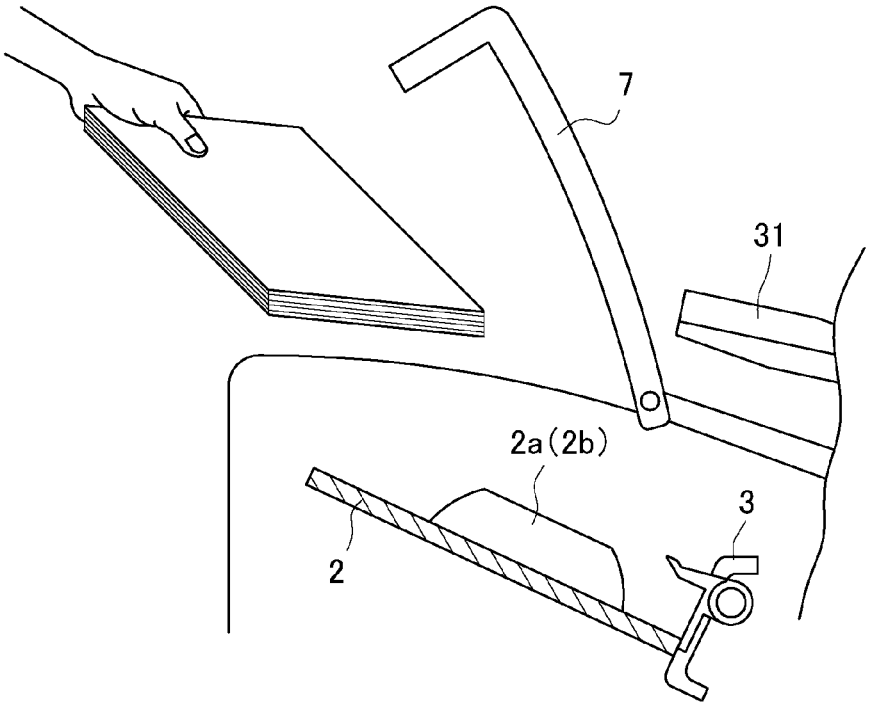
FIGS. 9A and 9B are explanatory views of essential portions of the unit shown in FIG. 1.
Figure 9B:
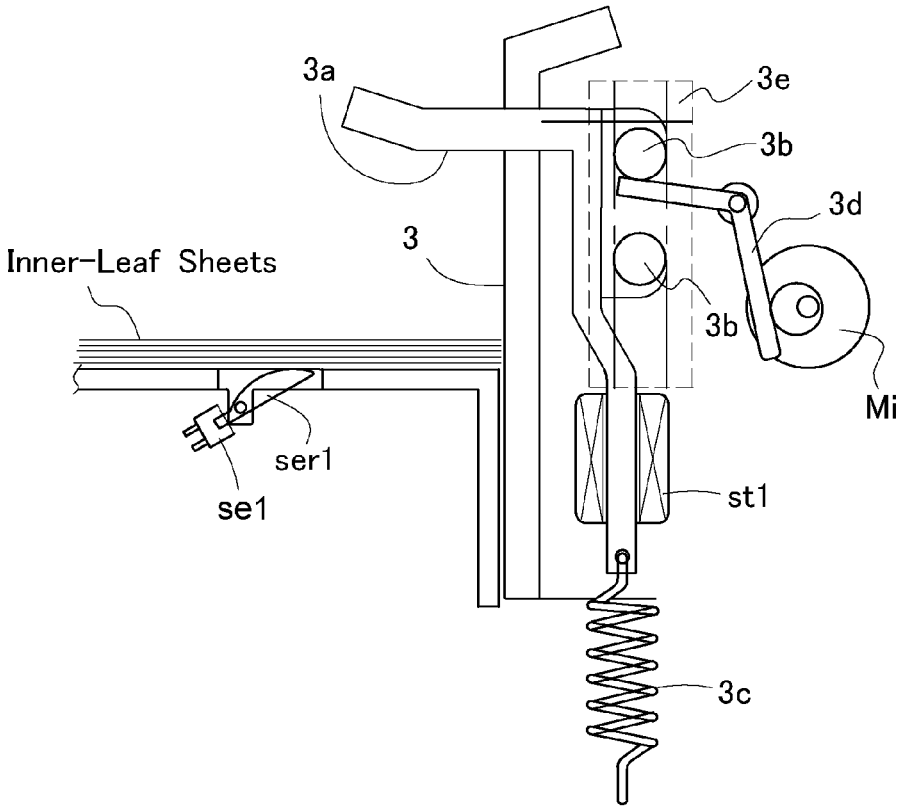

The first bundle-thickness detection means St is disposed to detect the thickness of the sheet bundle stacked on the inner-leaf tray 2. As shown in FIG. 9B, a paper contacting arm 3*a* that rises and lowers along a sheet aligning surface of the trailing edge aligning member 3 is supported by a shaft 3*b* on a guide member 3*e*. The bundle-thickness detection means St1 composed of a position detection sensor (hereinafter referred to as a "Slidac" sensor—Slidac being Toshiba Corp.'s registered trademark for a variable transformer) is provided on the paper contacting arm 3*a*. Also, the paper contacting arm 3*a* is constantly held at an idle position (the position shown in the drawing) over the tray via a transmission lever 3*d* by magnetic force (holding torque) from an elevator motor Mi. Also, when the elevator motor Mi is rotated in a clockwise direction at the sheet conveyance out instruction signal (described below), the paper contacting arm 3*a* lowers under its own weight or the force of an urging spring 3*c* to the top of an uppermost sheet of paper on the tray. The first sheet bundle thickness detection sensor St1 detects the position of the paper contacting arm 3*a* to detect the thickness of the sheet bundle set on the tray.

Tray Sensor Configuration

A first sensor Se1 is disposed on the inner-leaf tray 2 to detect the presence of sheets. (See FIG. 9B). The configuration of the sensor is known. For example, it is possible to adopt an empty sensor and the like, so any detailed explanation thereof will be omitted. However, the sensor is composed to detect the existence of sheets on the tray.

Configuration of Sheet Conveyance Means

Figure 3:
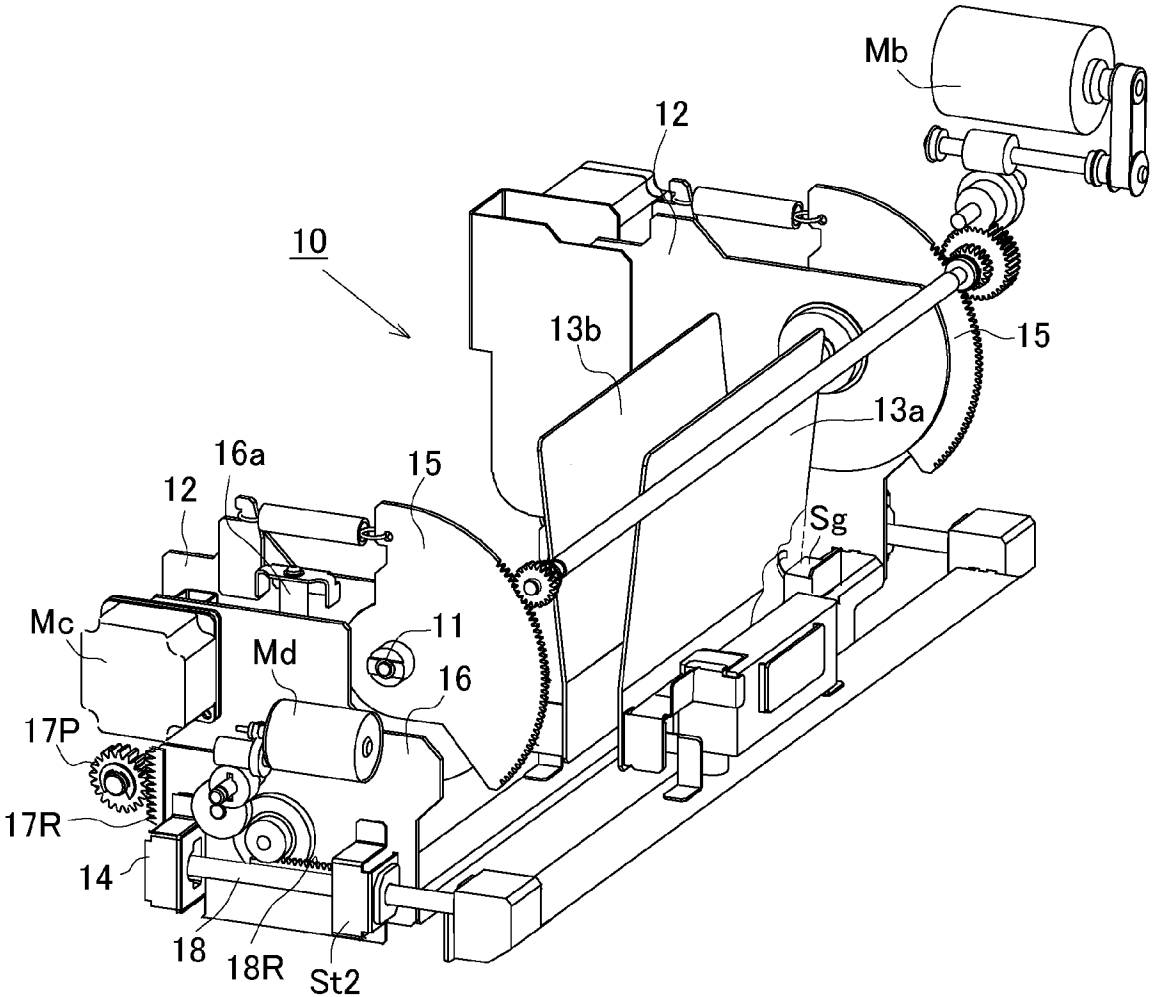
FIG. 3 is an explanatory drawing of a configuration of a bundle conveyance means in the unit shown in FIG. 1.

The inner-leaf conveyance means 10 that conveys the sheet bundle from the inner-leaf tray 2 to an downstream application position is composed as shown in FIGS. 2 and 3. The inner-leaf conveyance means 10 is disposed in the bookbinding path 5 disposed in a longitudinal direction to intersect the device in up and down directions, as shown in FIG. 1. The sheet bundle received from the inner-leaf tray 2 in a substantially horizontal orientation is turned 90° to become substantially vertically oriented. It is then conveyed to the downstream application position X. For that reason, the inner-leaf conveyance means 10 is composed of a pair of dampers 13*a*, 33*b* (13*a* is movable; 13*b* is fixed) that grip the sheet bundle, and a unit frame 12 that is equipped with both dampers 13*a*, 13*b*. Also, this unit frame 12 is rotatably supported on the apparatus frame by the rotating shaft 11. By rotatingly driving a fan-shaped gear 35 by a turning motor Mb equipped on the apparatus frame, the unit frame 12 turns in clockwise and counterclockwise directions of FIG. 3 around the rotating shaft 11.

As described above, the movable damper 13*a* and fixed damper 13*b* are risibly attached to the unit frame 12 rotatably supported on the apparatus frame. A movable frame 16 matingly supported by the guide rail (rod) 16*a* (partially shown in FIG. 3) is provided on the unit frame 12. The pinion 17P connected to an elevator motor Mc provided on the unit frame 12 and the gear rack 17R provided on the movable frame 16 are meshed. Therefore, the movable frame 16 is raised and lowered by the elevator motor Mc, and can convey sheets downstream along the bookbinding path 5.

The movable and fixed dampers 13*a*, 13*b* are mounted on the movable frame 16. The fixed side damper 13*b* is fastened to the left and right side frames that compose the movable frame 16 with a width size to grip sheets; a rod 18 is disposed on the movable side damper 13*a*, the rod 18 matingly supported by the bearing 14 provided on the movable frame 16. A pinion of the grip motor Md is meshingly linked to the gear rack 18R integrally formed on the rod 18.

Therefore, the movable damper 13*a* approaches the fixed damper 13*b* with the grip motor Md thereby nipping (gripping) sheets with the fixed damper 13*b*. Conversely, when the movable damper 13*a* separates from the fixed clamper 13*b* in an opposite direction, the nipping of the sheets is released (the grip on the sheets is freed). In this way, the dampers 13*a*, 13*b* are caused to grip the sheet bundle by the grip motor Md. The turning motor Mb changes the orientation of the sheet bundle from a horizontal orientation to a vertical orientation, then the elevator motor Mc moves the vertically oriented sheet bundle to the downstream application position X along the bookbinding path P5. Note that Sg in the drawing denotes the grip end sensor. The grip end sensor is disposed on the movable damper 13*a* to detect whether the sheet bundle has been securely gripped with the predetermined pressure.

Configuration of Second Bundle Thickness Detection Means

The second bundle-thickness detection means St2 is disposed on the movable flapper 13*a* to detect the thickness of the gripped sheet bundle. The movable damper 13*a* is caused to approach the fixed damper 13*b* as described above by the grip motor Md to grip the sheet bundle. This gripping action is detected by the grip end sensor Sg. This sensor detects the thickness of the sheet bundle being gripped when it detects the position of the movable damper 13*a* when the detection signal is issued. The sheets at this time are firmly compressed by an urging spring, not shown, so a highly precise detection of the sheet bundle thickness is possible. For that reason, the Slidac sensor that detects the position is disposed along with a bearing 14 on the rod integrated to the movable damper 13*a*. This sensor composes the second bundle-thickness detection means St2.

The sheet bundle thickness information detected by the second bundle-thickness detection means St2 (1) sets the gap between the adhesive applicator roll, described below, and the sheet bundle according to the thickness of the sheet bundle; (2) adjusts the setting position of the coversheet and the amount it is fed to correspond to the thickness of the sheet bundle so that the sheet bundle matches the center of the coversheet; (3) adjusts the starting position (idle position) of the spine folding press means, described below, to correspond to the sheet bundle thickness; and (4) adjusts the starting position (idle position) of the trimming means, described below, to correspond to the sheet bundle thickness. That information is used in finishing processes.

Configuration of Adhesive Application Means

Figure 4:
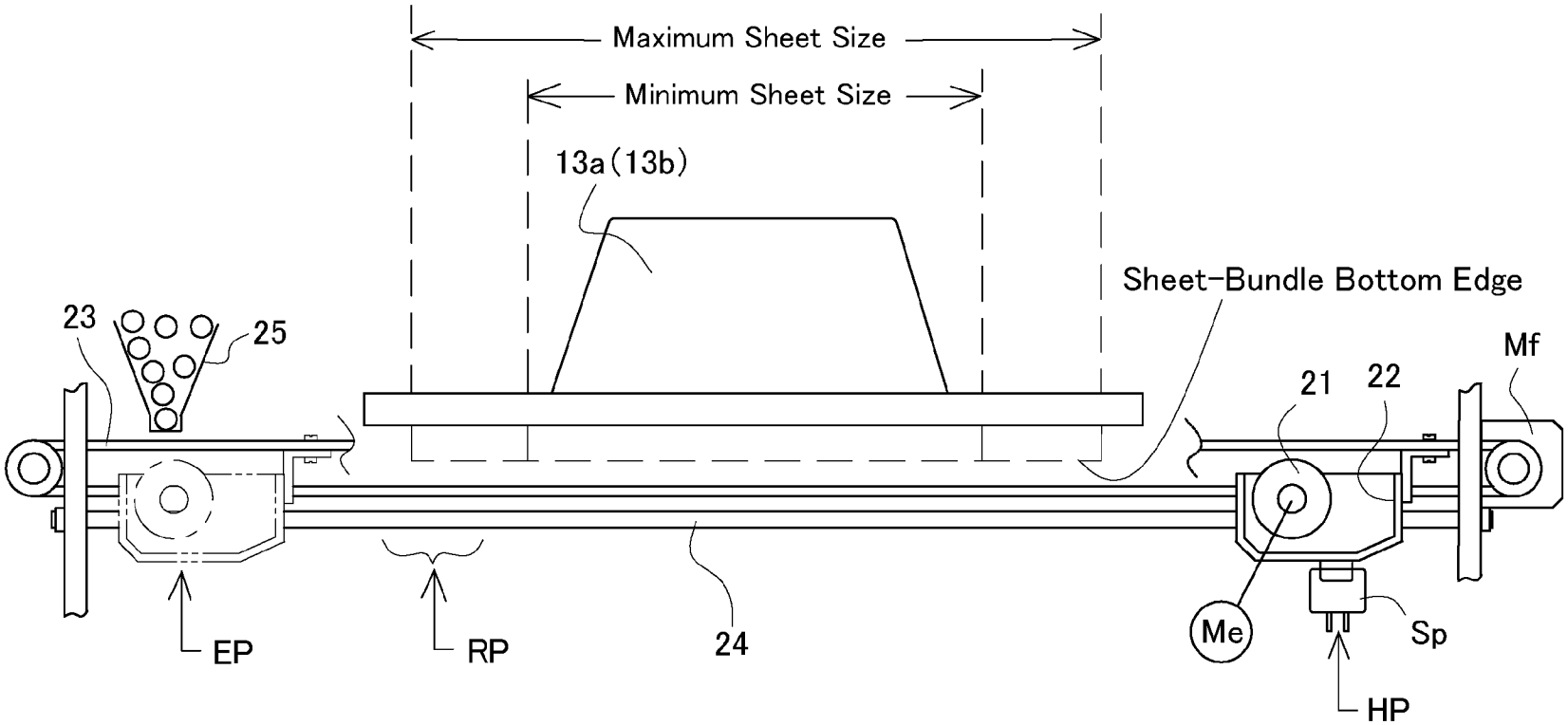
FIG. 4 is an overall view of adhesive application means in the unit shown in FIG. 1.

Adhesive application means 20 is composed of an adhesive container 21 that holds an adhesive, such as glue and the like; an applicator roller 22 rotatably installed in the container; a drive motor Me that rotatingly drives the applicator roller 22; and a drive motor Mf that reciprocates the adhesive container 21 along the sheet bundle. FIG. 4 is a conceptual view of the adhesive application means. The adhesive container 21 is formed to a shorter length (dimension) than the bottom side edge of the sheet bundle (the spine portion covered at the binding process). This is supported on a guide rail 24 (see FIG. 4) of the apparatus frame to move along the bottom side edge of the sheet bundle along with the applicator roller 22 installed in that container. The adhesive container 21 is connected to a timing belt 23 installed on the apparatus frame; a drive motor Mf is connected to the timing belt 23.

The adhesive container 21 shown in the drawings is configured to move along the sheet bundle, but it is also acceptable to adopt a tray shape that is longer than the length of the sheet bundle, and to move only the applicator roller 22 in the left and right directions of the drawing. Note that the applicator roller 22 shown in the drawing is composed of a porous and heat resistant material and is configured to be impregnated with adhesive. This enable adhesive to form layer on the circumference of the applicator roller.

The drive motor MF reciprocates the adhesive container 21 between a home position HP and a return position RP where the return operation is started along the sheet bundle, and to a refilling position where adhesive can be charged to the container. Each position is set to the positional relationships shown in FIG. 4; the return position RP is set based on sheet width size information. The adhesive container 21 is set to the home position HP when the power is turned on (at device initialization). For example, this moves from the home position HP to the return position RP after a predetermined amount of time (estimated time for the sheet bundle to reach the adhesive application position) after a sheet grip signal of the grip end sensor Sg of the inner-leaf conveyance means 10. At the same time as this movement, the drive motor Me starts rotating the applicator roller 22. Note that Sp in the drawings denotes the home position sensor of the adhesive container 21.

Figure 5A:
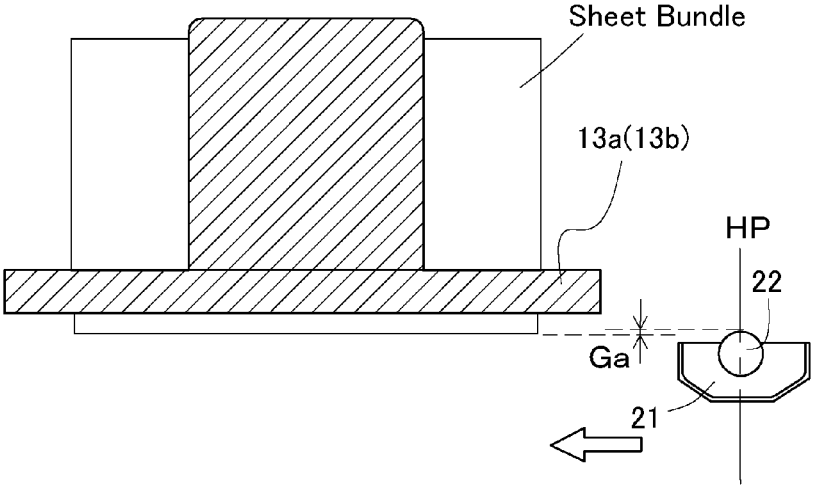
FIGS. 5A to 5D are explanatory views of applying adhesive using an adhesive application means shown in FIG. 4.
Figure 5C:
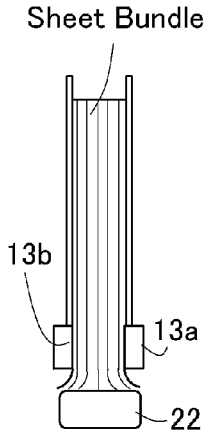

With the rotation of the drive motor Mf, the adhesive container 21 starts moving from the left side of FIG. 4 to the right side along the guide rail 24. The amount of travel of the inner-leaf conveyance means 10 is adjusted by the elevator motor so that the applicator roller 22 pressingly contacts the sheet bundle to slightly separate the edges of the sheets (see FIGS. 5A and 5C) in the advancing path, and forms a predetermined gap Ga with the sheet bundle edge in the return path (to return from the return position RP to the home position HP) to apply adhesive (see FIGS. 5B and 5D). The adjustment of the amount of adhesive using the amount of travel of the sheet bundle is based on the sheet bundle thickness information from the second bundle-thickness detection means St2. If the sheet bundle is thick, the gap Ga is widened to increase the amount of adhesive applied. If the thickness is small, the gap Ga is narrowed to reduce the amount of adhesive applied.

Instead of controlling the elevator motor Mc of the inner-leaf conveyance means 10 to adjust the amount of travel of the sheet bundle, it is also acceptable to equip roller position adjusting means that adjust the up/down position of the applicator roller 22. When the drive motor Mf moves the adhesive container from the operating position where adhesive is applied to the sheet bundle to the idle position EP separated therefrom at the idle instruction signal, adhesive can be recharged from an adhesive tank 25 disposed in the idle position EP.

Figure 7A:
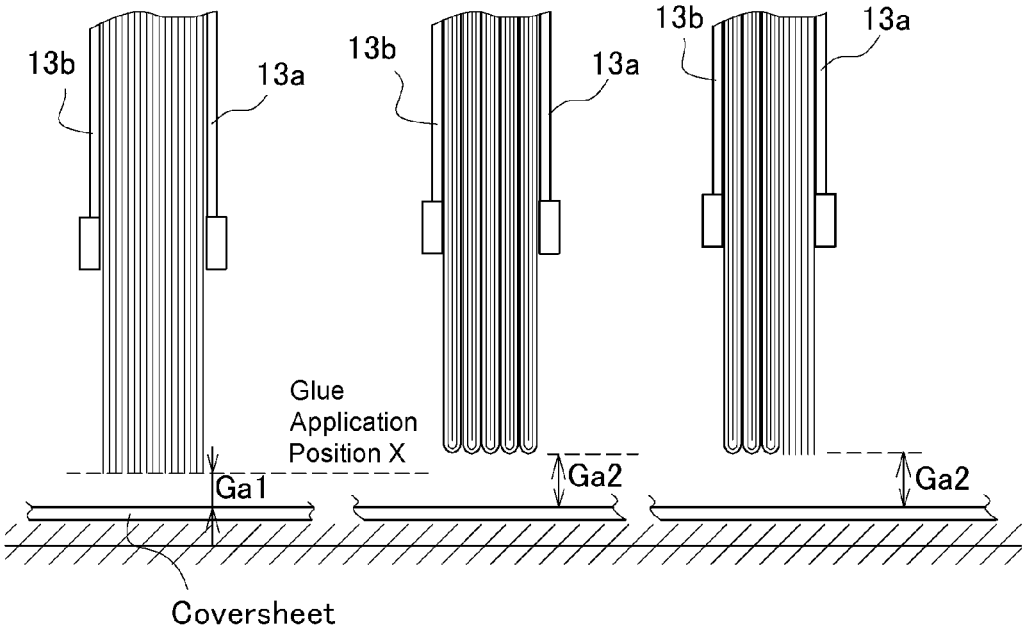
FIGS. 7A to 7D are explanatory views of a configuration of a bundle of saddle-stitch sheets in the unit shown in FIG. 1.
Figure 7B:
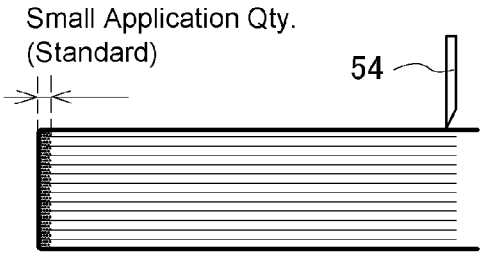
Figure 7C:
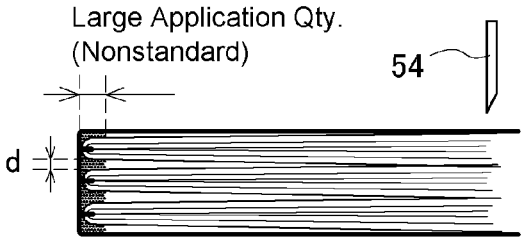
Figure 7D:
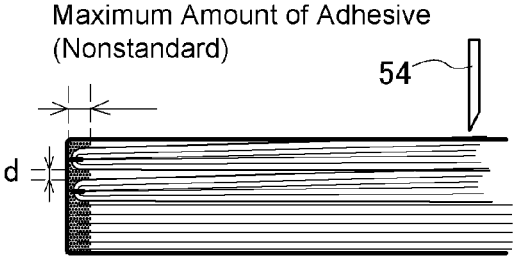

The unit shown in FIG. 1 has a feature to set the gap Ga based on the "bundle makeup" information of the inner-leaf sheets, described below, at the same time as the sheet bundle thickness information from the second bundle-thickness detection means St2, when setting the gap Ga. The bundle composition of the inner-leaf sheets is input using a control device B, described below. Input selections can be either "composed of only simple sheets in the state shown in FIG. 7B (hereinafter referred to as simple sheets)," "composed of simple sheets and saddle-stitch sheets in the state shown in FIG. 7D (hereinafter referred to as mixed sheets)," or "composed only of saddle-stitch sheets in the state shown in FIG. 7C (hereinafter referred to as folded sheets)." Here, the gap Ga is set so that the standard gap Ga1 for simple sheets, and the non-standard gap Ga2 for mixed sheets or folded sheets have a relationship of Ga2>Ga1. (See FIG. 7A) Note that in this case, the differences in gaps are determined by experiment for the properties of the adhesive being used.

Coversheet Feeder Unit

The sheet bundle applied with adhesive at the adhesive application means 20 is bound to the coversheet, but the feeding of the coversheet will now be explained. The coversheet feeder unit B disposed over the bookbinding unit A is composed of one or a plurality of coversheet stacking trays 31 for stacking sheets (a drawing shows two tiers of stacking trays), pickup means 32 for separating sheets on the coversheet stacking tray 31 into single sheets, and a coversheet feeding path 6 for guiding a sheet from the pickup means 32 to the binding position Y.

Special sheets such as thick or coated sheets are prepared as coversheets in the coversheet tray 31. A sheet on the stacking tray is conveyed to the coversheet conveyance path 6 at a control signal sent from the bookmaking unit A. The reason why there is a two-tiered approach to the coversheet stacking trays 31 is that it is possible to prepare different types of coversheets on the trays in advance, so the operator can select the type of coversheet to bind to the sheet bundle from the selected stacker.

Configurations of Coversheet Conveyance Path

The configuration of the coversheet conveyance path 6 will now be explained with reference to FIG. 2. The coversheet conveyance path 6 conveys and sets a coversheet from the coversheet tray 31 to the binding position Y established at the intersection of the bookbinding path 5. Particularly, a feature of the unit shown in the drawing is that the length of the coversheet conveyance path 6, in other words the length of the path from the coversheet tray 31 to the binding position Y (L1, not shown) and the length of the path from the inner-leaf tray 2 of the bookbinding path 5 to the binding position Y (L2; not shown) are set to a relationship of L1>L2. To make the unit more compact, the inner-leaf tray 2 and coversheet tray 31 are arranged one above the other, and the length (L1) of the path of the coversheet tray is longer than the length (L2) of the path of the inner-leaf tray 2. This makes a more compact unit possible that conveys a coversheet requiring twice the length of the inner-leaf sheets to the binding position Y.

The conveyance roller that conveys the coversheet and an aligning mechanism 35 are disposed in the coversheet conveyance path 6. A path guide that forms the coversheet conveyance path 6 is composed of movable guides 36*a*, 36*b* that move up and down between a guiding orientation and a retreated orientation upstream and downstream of the binding position Y. (See FIG. 2) This guide is positioned in the guiding orientation (see the state shown in FIG. 3) to guide the coversheet to the binding position Y, and is shifted to the retreated orientation (not shown) when the coversheet is being folded.

The aligning mechanism 35 is composed of nipping claw 35*a* that engages a trailing edge of the coversheet, an aligning member 35*b* that offsets in a direction perpendicular to the direction of conveyance the coversheet gripped by the nipping claw 35*a*, and a forward and reverse drive roller 35*r* that switches back the coversheet conveyed in the coversheet conveyance path 6 to abut the nipping claw 35*a*, provided in the coversheet conveyance path 6. The forward and reverse drive roller 35*r* is composed to move up and down with regard to its retreated idle position above the coversheet.

Therefore, the coversheet conveyed into the coversheet conveyance path 6 is switched back and conveyed by the reverse drive of the forward and reverse drive roller 35*r* at a predetermined timing after its trailing edge passes the aligning mechanism 35. Then, the trailing edge of the sheet abuts the nipping claw 35*a* which corrects any skewing of the sheet. In this state the nipping claw 35*a* grips the trailing edge of the sheet and the aligning member 35*b* equipped with this nipping claw 35*a* moves in a direction perpendicular to the direction of sheet conveyance to align the sides of the sheet. This corrects any skewing the coversheet may have in the leading and trailing edge directions of sheet conveyance, and the position of the sheet in its width direction (a direction perpendicular to the direction of sheet conveyance) (in other words correction of the side edge positions). The coversheet that has been aligned is conveyed toward the downstream binding position Y by the forward and reverse drive roller 35*r*. Conveying and setting the sheet at the binding position Y is performed by the coversheet conveyance means (roller) 30 conveying the coversheet from the aligning position a predetermined amount.

Configuration of Coversheet Size Detection Means

In the same way as the inner-leaf tray 2, a second sensor Se2 that detects the presence of sheets on the tray and coversheet width size detection means SS2 that detects the width of the sheets on the tray are disposed in the coversheet tray 31. The second sensor Se2 has the same configuration as that in the inner-leaf tray 2 explained with reference to FIG. 9, and the detection means SS2 has the same configuration as that in the inner-leaf tray 2 explained with reference to FIG. 10; both sensors are disposed in the coversheet tray 31.

A coversheet length size detection sensor SS3 that detects a trailing edge of the conveyed coversheet is disposed in the coversheet conveyance path 6. The length of the sheet is calculated using the time from when this sensor detects the leading edge of the coversheet to the time it detects the trailing edge of the coversheet and the sheet conveyance speed.

Configuration of Cover Binding Means

Adhesive is applied by the adhesive application means 20 to the bottom edge of the sheet bundle gripped by the inner-leaf conveyance means 10 at the sheet bundle conveyance path P5, and the adhesive container 21 is then retracted to its home position HP outside of the path. The inner-leaf conveyance means 10 moves the sheet bundle along the bookbinding path 5 from the application position X to the binding position Y. At the same time, a coversheet is conveyed to the binding position Y and set at the coversheet conveyance path 6. Cover binding means 40 is provided at the binding position Y. This cover binding means 40 is composed of a spine rest plate 41 and spine-folding press members 42.

Configuration of Spine Rest Plate

Figure 6:
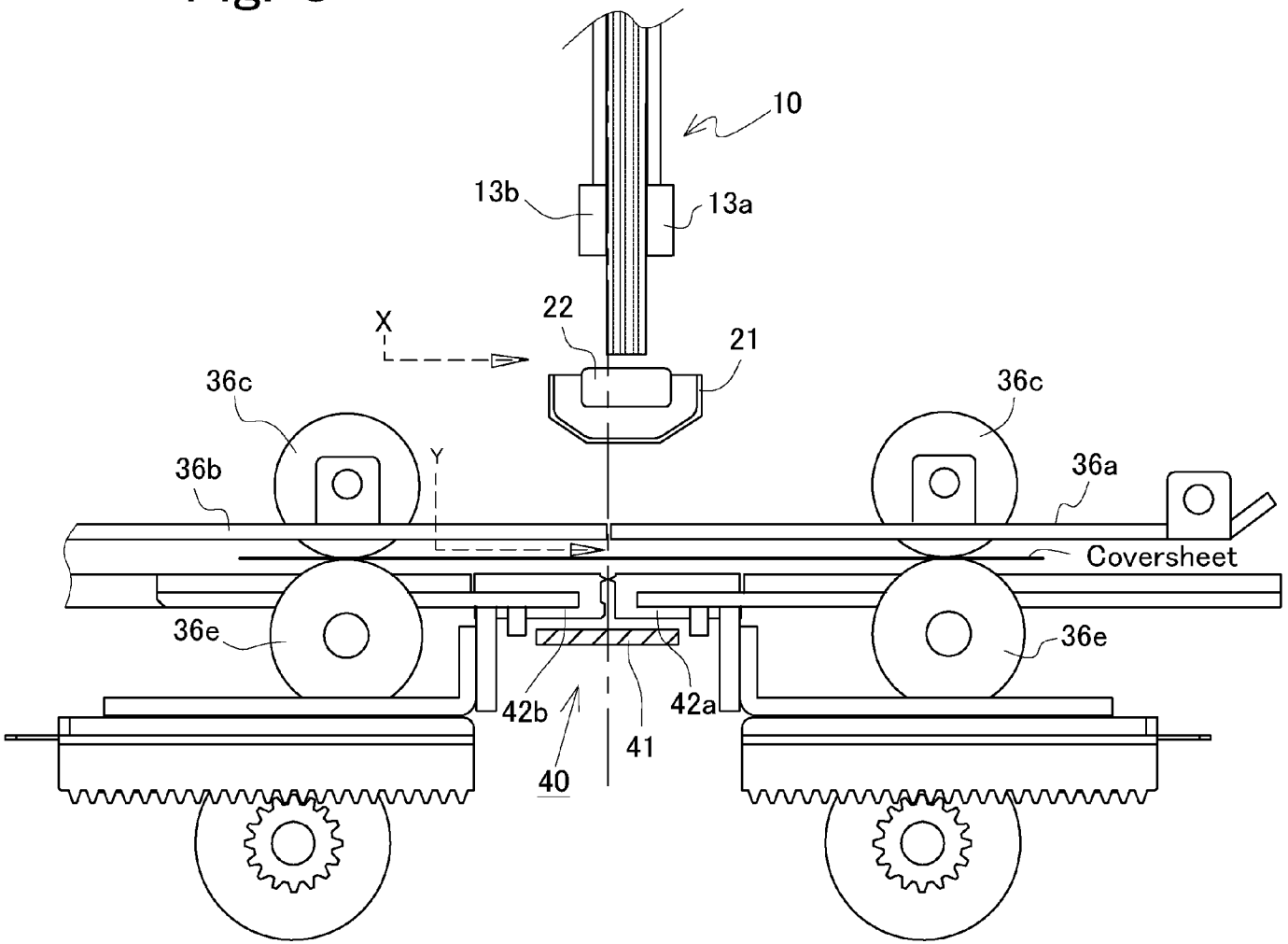
FIG. 6 is an explanatory view of a configuration of bundle conveyance means in the unit shown in FIG. 1.

As shown in FIG. 6, the shutter vane-shaped spine rest plate 41 that intersects the bookbinding path 5 is disposed in the binding position Y. This spine rest plate 41 is disposed directly under (at the downstream side) the spine-folding press members 42*a*, 42*b* at the binding position Y of the bookbinding path 5. These spine-folding press members 42*a*, 42*b* cooperate to fold the coversheet. The spine rest plate is configured to move between an operating position positioned in the bookbinding path 5, and is configured to be advanced and retreated by drive means (such as a solenoid and the like), not shown. Also, the spine rest plate 41 is formed by a metal plate with high coefficient of thermal conductivity and good heat dissipation effect, and can cool the adhesive (hot-melt adhesive is shown in the drawing) applied to the sheet bundle.

Control of Spine Press Members

Figure 8A:
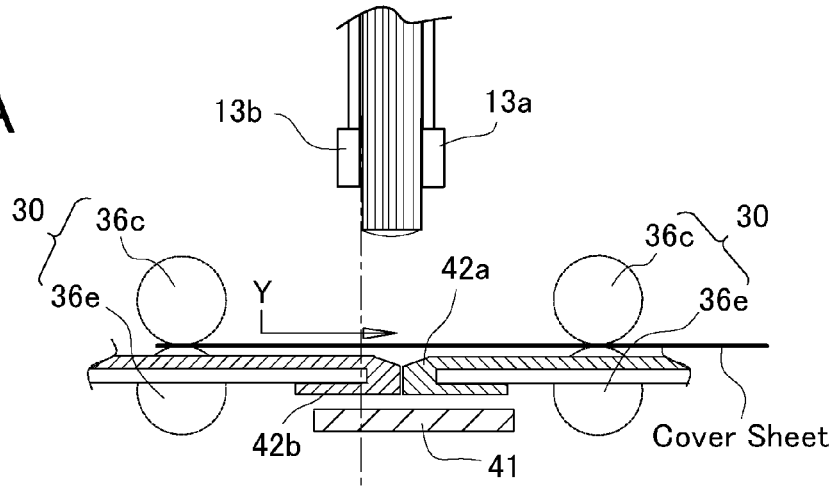
FIGS. 8A to 8C are explanatory views of operations of coversheet binding procedures in the unit shown in FIG. 2; each drawing shows spine folding press members moving between idle positions and folding positions.
Figure 8B:
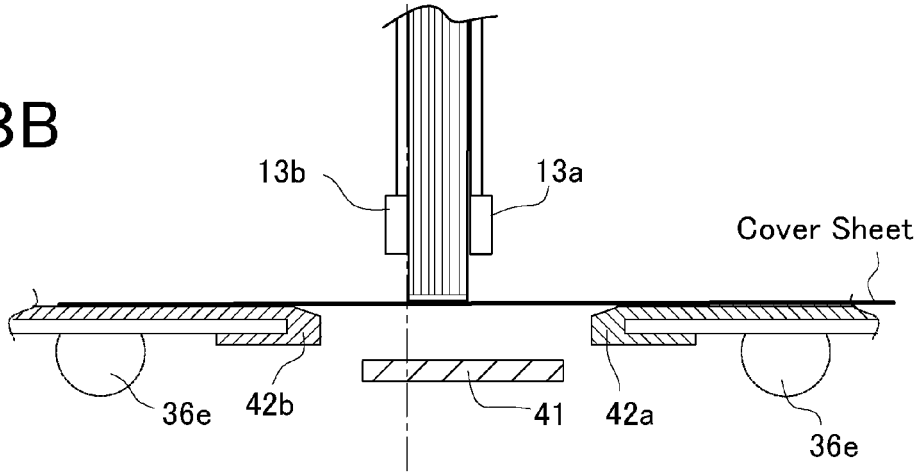
Figure 8C:
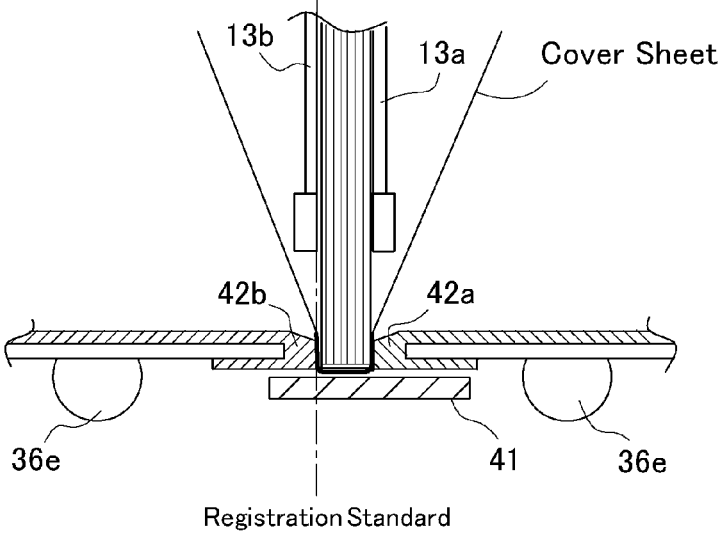

The control of the spine press members 42*a*, 42*b* will now be explained. The spine press members 42*a*, 42*b* are controlled to be positioned at the spine folding position (see FIG. 8A) when a coversheet is fed from the coversheet conveyance path 6 to the binding position Y, and to be positioned at their home positions (see FIG. 8B) retracted from the bookbinding path 5 when the sheet bundle and coversheet from the bookbinding path 5 are being joined. Next, the spine press members 42*a*, 42*b* fold the coversheet in the process of moving from their home positions to the spine folding positions (FIG. 8C). A transmission mechanism such as a drive motor, and rack and pinion are installed on the left and right spine press members 42*a*, 42*b*.

Configuration of Bundle Posture-Reorienting Means

The following will now explain the finishing process for the sheet bundle formed into a booklet. The finishing process trims true three side edges of the sheet bundle in booklet form excluding the spine portion. Folding rollers 45 are disposed downstream of the cover binding means 40. Further downstream, a bundle-posture reorienting means 46 that turns the sheet bundle over from top to bottom, and trimming means 50 that trims true the edges of the sheet bundle are disposed in the trimming position Z positioned further downstream. The bundle posture changing means 46 turns the covered sheet bundle fed from the binding position Y to a predetermined direction (or orientation) and conveys the sheet bundle to the downstream trimming means 50 or to the storage stacker 57. The trimming means 50 trims the fringes of the sheet bundle to align the edges. Therefore, the bundle posture changing means 46 is equipped with swivel tables 47*a*, 64*b* that grip and turn the sheet bundle fed from the folding rollers 45. As shown in FIG. 1, the swivel tables 47*a*, 47*b* are furnished on the unit frame 48 installed on the apparatus frame to rise and lower. The pair of swivel tables 47*a*, 47*b* that sandwich the bookbinding path 5 are rotatably supported on bearings in the unit frame 48; one of the movable swivel tables 47*b* is supported to move in a sheet bundle thickness direction (a direction orthogonal to the bookbinding path 5). Spinning motors, not shown, are furnished in the bookbinding path for the swivel tables 47*a*, 47*b* to change the posture (or orientation) of the sheet bundle.

Configuration of Trimming Means

Trimming means 50 are provided downstream of the bundle posture changing means 46.As shown in FIG. 1, the trimming means 50 is composed of a trimming edge pressing member 52 that pressingly supports the edge of the sheet bundle to be trimmed against a blade-edge bearing member 51, and a trimming blade unit 53. The trimming edge pressing member 52 is disposed in a position that opposes the blade-edge bearing member 51 disposed in the bookbinding path 5, and is composed of a pressing member that is moved in a direction that is perpendicular to the sheet bundle by drive means, not shown. The trimming blade unit 53 is composed of a flat, blade-shaped trimming blade 54 and a cutter motor Mh that drives that blade. The trimming means 50 with this configuration cuts a predetermined amount around the edges, excluding the spine of the sheet bundle that has been made into a booklet, to align the edges.

A discharge roller 55 and storage stacker 57 are disposed downstream of the trimming position Z. This storage stacker 57 stores sheet bundles in an inverted manner as shown in FIG. 1. This storage stacker 57 is disposed to be drawn from the unit as shown in FIG. 1. The stacker can be drawn toward the front side of the apparatus (the front side of the sheet in FIG. 1). The operator can view it from the top direction when it is drawn to the front of the unit.

Configuration of Control Means

Figure 11:
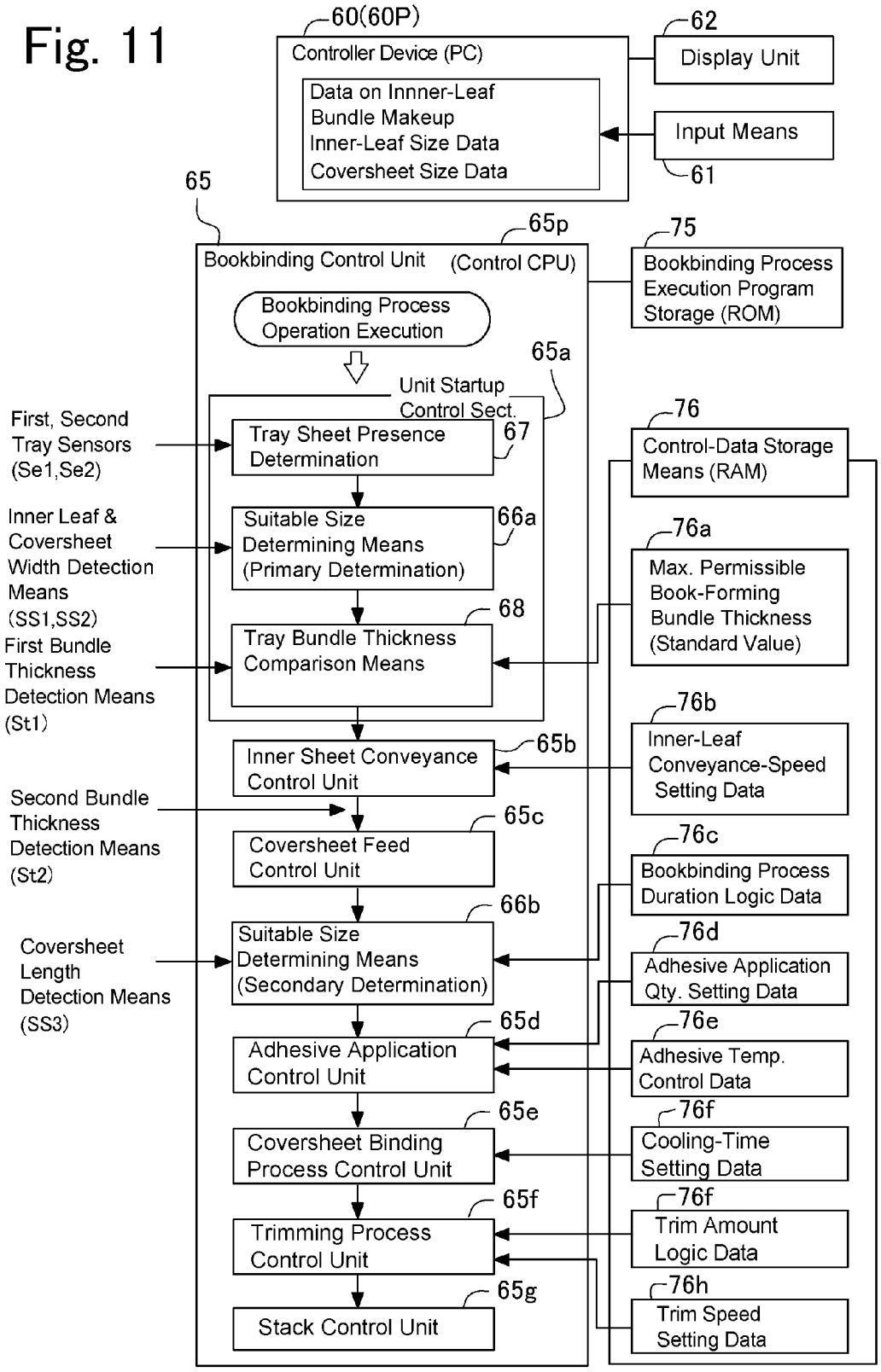
FIG. 11 is a block diagram of a configuration of control means in the unit shown in FIG. 2.

The following will now explain the control of the bookbinding unit A shown in FIG. 1. FIG. 11 is a block diagram shown a configuration of the controls. The control is composed of a bookbinding control unit 65 furnished in the bookbinding unit A, and a controller 60. The controller 60 in the drawing is composed of a computer device. As shown in the drawing, the controller 60 is composed of an input means 61, display unit 62 and control CPU60P; the bookbinding control unit 65 is composed of a control CPU65P built-in to the bookbinding unit A.

The controller 60 performs the role of input means 61 for inputting processing conditions when binding a booklet, a memory means for storing inputted data, and the function of the display means 62 for displaying a jam or other states of the bookbinding process. Note that the controller 60 can also be integrated to the bookbinding control unit 65.

Particularly, the "size of the saddle-stitch sheets," "coversheet size," and "inner-leaf sheet bundle makeup" are input with the unit shown in the drawing. This information is used as the control conditions for the bookbinding processes described below. Also, although not shown, it is possible to add functions to the controller 60. For example, a layout function that adjusts the coversheet setting position so that the title formed on the spine of the coversheet is positioned in the center, or a function for setting the bookbinding process such as adjusting the amount of adhesive that is applied to the sheet bundle according to the properties of the adhesive being used can be added for the aspects of the bookbinding process. When using a computer as the controller 60, it is simple to add these functions or create programs to correct them.

A ROM 75 that stores a program for executing the bookbinding operation, and a RAM 76 that stores data that sets the control conditions are connected to the bookbinding control unit 65. The bookbinding control unit 65 is composed of the unit starting control unit 65*a*, the inner-leaf conveyance control unit 65*b*, the coversheet conveyance control unit 65*c*, the adhesive application control unit 65*d*, the coversheet binding process control unit 65*e*, the trimming process control unit 65*f*, and the stack control unit 65*g*.

An appropriate size determining means 66 is incorporated in the bookbinding control unit 65 for determining whether the size of sheets prepared in the inner-leaf tray 2 and the coversheet tray 31 are capable of performing the predetermined bookbinding operation. This means is composed of a primary determining means 66*a* for determining the size using the sheet width size, and a secondary determining means 66*b* for determining the size using the sheet length. The primary determining means 66*a* is incorporated in the unit starting control unit 65*a*.

The unit starting control unit 65*a* is equipped with a first sensor Se1 disposed in the inner-leaf tray 2; a sheet presence determining means 67 for determining whether saddle-stitch sheets and coversheet have been set in the trays using signals from a second sensor Se2 disposed in the coversheet tray 31; primary determining means 66*a* of the appropriate size determining means; and the tray sheet bundle thickness comparison means 68. Data 76*a* of the maximum sheet bundle thickness that can be gripped by the inner-leaf conveyance means 10 is provided from the RAM76 to the comparison means 68.

The unit starting control unit 65*a* configured as described above is configured to determine whether sheets have been set in the inner-leaf tray 2 and coversheet tray 31, whether the widths of the sheets match, and whether the thickness of the sheet bundle set in the inner-leaf tray 2 exceeds the maximum permissible thickness of a sheet bundle.

The inner-leaf conveyance control unit 65*b* controls the inner-leaf conveyance means 10. If predetermined conditions are met at the unit starting control unit 65*a*, the inner-leaf conveyance means 10 is started to convey inner-leaf sheets from the inner-leaf tray 2 into the unit. For that reason, the speed setting data 76*b* to be set based on the "bundle makeup information" from the input means 61 is received from RAM76 to set the speed to convey the inner-leaf sheets. The second bundle-thickness detection means St2 detects the thickness of the sheet bundle gripped by the inner-leaf conveyance means 10 and that thickness information is stored in an internal memory.

The coversheet conveyance control unit 65*c* starts the pick-up means disposed in the coversheet tray 31 and feeds one sheet from the tray at a time. The coversheet length detection means SS3 disposed in the coversheet conveyance path 6 detects the length of the coversheet. The secondary determining means is provided to determine whether the length of the coversheet is able to perform the predetermined bookbinding process, based on the value of that detection. Operation data 76*c* that calculates a length of the bookbinding process is supplied from the RAM76 in the control unit. Also, a conveyance amount operation means (not shown) is provided in the coversheet conveyance control unit 65*c* for positioning the coversheet in the binding position Y based on the sheet bundle thickness detected by the second bundle-thickness detection means St2.

The adhesive application control unit 65*d* is composed of an adhesive amount setting means and temperature setting means. Adhesive amount setting data 76*d* and adhesive temperature control data 76*e* are provided from RAM76. Particularly, the adhesive amount setting means sets the adhesive amount based on bundle makeup information of the inner-leaf sheets, and sheet bundle thickness information detected by second bundle thickness detection means. This is configured to adjust the coating gap Ga between an edge of the sheet bundle in the inner-leaf conveyance means 10 and applicator roller according to that setting.

This coversheet binding control unit 65*e* controls the spine rest plate 41 and spine-folding press members 42*a*, 42*b*. That control is configured to execute the operations explained with reference to FIG. 8. Cooling time setting data 76*f* for cooling adhesive is supplied from RAM76 when the coversheet binding control unit 65*e* touches the spine covering portion against the spine rest plate 41 after the binding process. This cooling time setting data selects one of a plurality of data based on the inner-leaf sheet thickness configuration information.

The trimming process control unit 65*f* is composed of operation means that calculates the trimming amount using the trimming blade 54, speed setting means for setting the trimming speed of the trimming blade 54 and stroke setting means for setting the movement stroke of the trimming blade 54. Also, the trimming amount operation means is configured to calculate the trimming about using inner-leaf sheet size information, coversheet size information, and sheet bundle thickness information detected by the second bundle-thickness detection means St2. The speed setting means is configured to set the cutting speed using the inner-leaf sheet bundle makeup information. The stroke setting means sets the trimming starting position (the idle position) of the trimming blade using sheet bundle thickness information.

The stack control unit 65*g* controls the discharge roller 55 and is configured to store sheet bundles conveyed from the bookbinding path 5 in the storage stacker.

Explanation of Bookbinding Operation

Figure 12A:
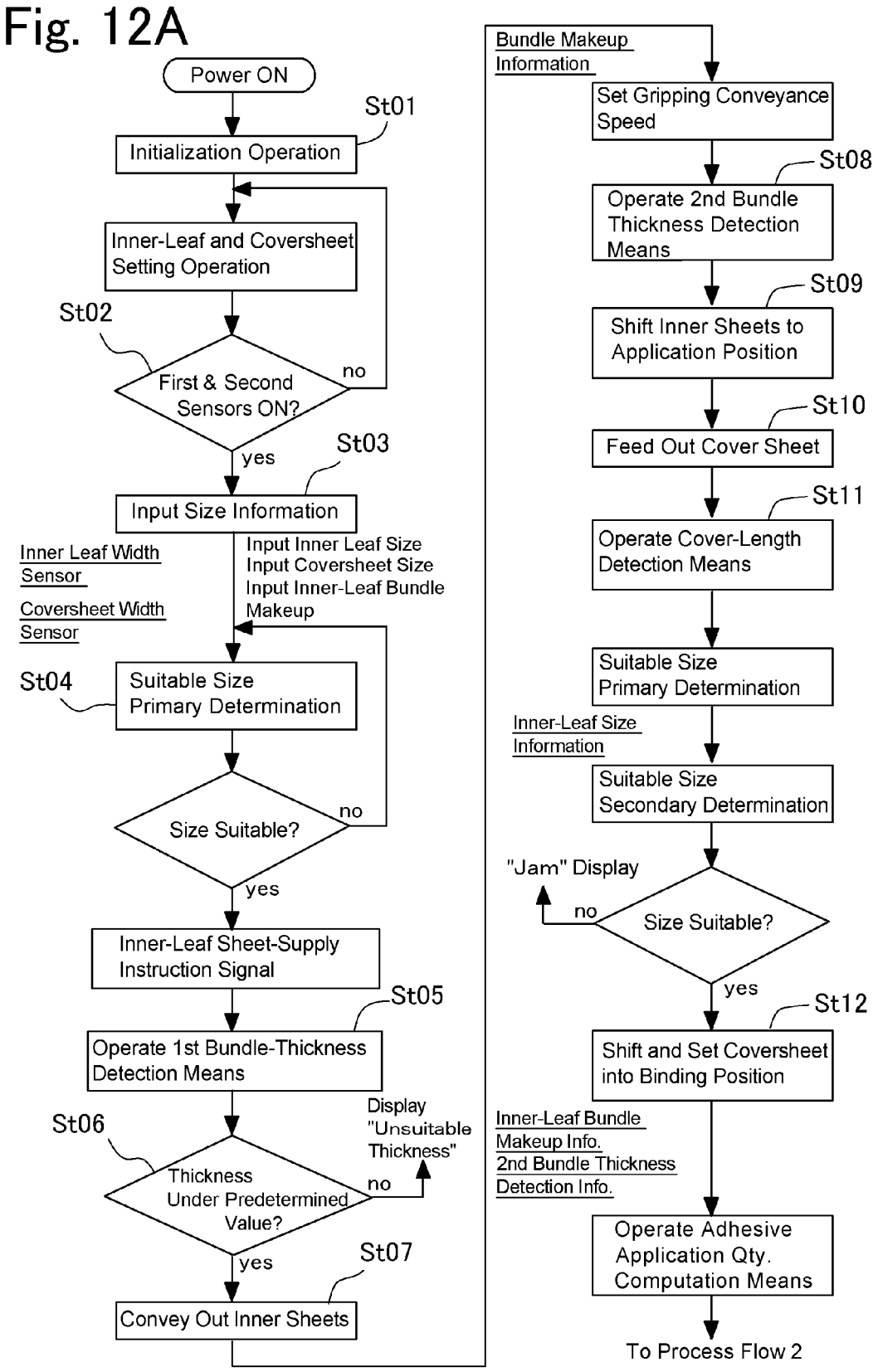
FIG. 12A is a flowchart showing operating procedures of cover binding means in the unit shown in FIG. 2.
Figure 12B:
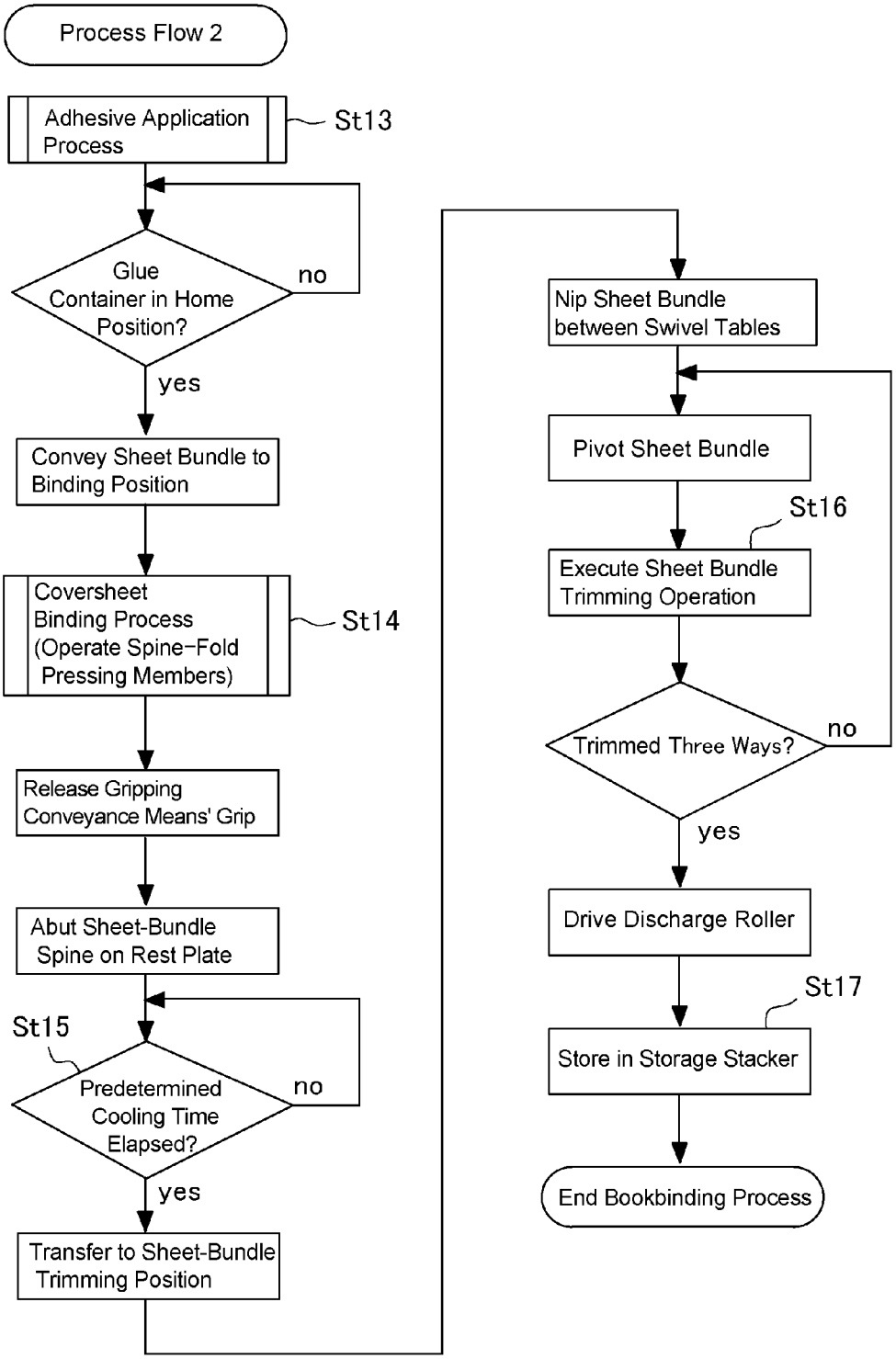
FIG. 12B is a flowchart showing operating procedures of cover binding means in the unit shown in FIG. 2.

The bookbinding procedures in the unit shown in FIG. 1 will now be explained with reference to the flowchart shown in FIG. 12. The unit shown in FIG. 1 is configured to perform the following bookbinding operations using the bookbinding control unit 65 disposed in the bookbinding unit A and the controller 60 disposed in the computer device connected to the bookbinding control unit 65.

Initial Operations

First, the bookbinding control unit 65 executes an initialization operation when the unit power is turned ON. (St01). When the unit power is turned ON, the control unit composed of the control CPU65P detects whether there are any sheets remaining in the bookbinding path 5 and coversheet conveyance path 6. If there is a sheet existing in either of the paths, the control CPU65P issues a "jam" warning. Along with this, the adhesive application means 20, the cover binding means 30 and the trimming means 50 are set to their initial states (home positions).

Sheet-Setting Operation

Next, the controller 60 detects whether there is a sheet in the inner-leaf tray 2 and coversheet tray 31. The first and second sensors Se1 and Se2 disposed in each tray detect (determine) whether there are sheets (St02). When both sensor means Se1 and sensor means Se2 are ON, the system waits for sheets to be prepared in the trays and when both are ON, the system shifts to the next step.

Size Information Input

The controller 60 then prompts for input of the coversheet size information, inner-leaf sheet size information and inner-leaf sheet bundle makeup information from the input device (means) 61. That information can be selected or directly input via a computer. In such a case, sensors can be provided in each tray to detect sheet sizes using inner-leaf sheet size information and coversheet size information. However, the drawing shows only the inner-leaf sheet width size detection means SS1 disposed to detect the size of the inner-leaf sheet, and the coversheet width size detection means SS2 that detects the size of the coversheet is positioned in the coversheet tray 31; the coversheet length size detection means SS3 that detects the length of the sheet is disposed in the coversheet conveyance path 6. The system is configured to make a primary determination of whether the inner-leaf sheets and coversheet can perform the predetermined bookbinding operation using the width size information, and then a secondary determination using the coversheet length information.

Sheet-Bundle-Makeup Information Input

Further, for "inner-leaf sheet bundle makeup information" a user is prompted to input, using the input means 61 of the controller 60, the structural makeup of a bundle of inner-leaf sheets set on the inner-leaf tray 2. The user inputs whether the inner-leaf sheets collated into a sheet bundle are: constituted from simple sheets only ("simple-sheet makeup" hereinafter), constituted from simple sheets and saddle-stitch folded sheets ("mixed-sheet makeup" hereinafter), or constituted from saddle-stitch folded sheets only ("folded-sheet makeup" hereinafter). This bundle makeup information is used to set the control conditions, described below, of the bookbinding process that follows.

Suitable Size Primary Determination

The controller 60 performs the primary determination of whether the predetermined bookbinding process is possible with each sheet using a conforming sheet determination means 66*a* based on detection results from the inner-leaf sheet width detection means SS1 disposed in the inner-leaf tray 2 and the coversheet width detection means SS3 disposed in the coversheet tray 31. (Step St04) Determining whether the inner-leaf sheet width and coversheet width (the length in the top to bottom direction after the bookbinding process) match determines whether the predetermined bookbinding process is possible. Also, the bookbinding control unit 65 prohibits shifting to the later processes (St05) when both sheet widths do not match, and issues a "size mis-match" warning to the operator at the same time. If the operator inputs in instruction to "continue process with unmatched sizes," this is cleared and the system shifts to the next step.

Operation of First Bundle Thickness Detection Means

Next, the controller 60 issues an "inner-leaf conveyance out" command to convey out the inner-leaf sheet set in the inner-leaf tray 2 toward the inner-leaf conveyance means 10. When this command is received (when sizes match in the primary determination), the bookbinding control unit 65 detects the thickness of the inner-leaf sheet bundle set in the inner-leaf tray 2. This is detected using the first bundle-thickness detection means St1 disposed in the inner-leaf tray 2. (First sheet bundle thickness detection; St05) This sheet bundle thickness is canceled by rotating the paper contacting arm 3*a* held magnetically at its initial position (the uppermost position) in advance with the rotation of the elevator motor Mi. The paper contacting arm 3*a* is lowered by an urging spring 3*c* to touch the uppermost sheet on the tray. At this time, the position of the paper contacting arm detects the sheet bundle thickness by detection using the Slidac sensor.

The controller 60 determines whether the sheet bundle can be conveyed based on detection values for the first bundle-thickness detection means St1. (St06) The detection value and the preset maximum permissible sheet bundle thickness of the inner-leaf conveyance means 10 are compared for this determination. The controller 60 then determines whether the detection value exceeds the maximum permissible sheet bundle thickness. When it is determined that the maximum permissible sheet bundle thickness has been exceeded, the saddle-stitch sheet conveyance out is prohibited. The controller 60 warns the operator by displaying on a display unit that the maximum sheet bundle thickness permissible for bookbinding has been reached.

Operations for Conveying Out Inner-Leaf Sheets

When the number of inner-leaf sheets is determined to be less than the maximum permissible sheet bundle thickness in the first sheet bundle thickness determination, the bookbinding control unit 65 hands the inner-leaf sheets to the downstream inner-leaf conveyance means 10. For that reason, the unit in the drawing lowers the inner-leaf tray 2 from the setting position to the conveyance out position. After the tray is lowered, the inner-leaf conveyance means 10 grips the sheet bundle on the tray using the fixed damper 13*b* and the movable damper 13*a*. A sheet feeding means, not shown, is installed in the inner-leaf tray 2. This pushes the sheet bundle along the tray to the inner-leaf conveyance means 10. The sheet bundle on the tray is conveyed out to the downstream inner-leaf conveyance means 10 (St07).

Second Sheet-Bundle Thickness Detection

The inner-leaf conveyance means 10 that transfers the inner-leaf sheets as described above changes the orientation of the sheet bundle simultaneous to the sheet bundle thickness being detected. The inner-leaf conveyance means 10 nips the sheet bundle between the fixed damper 13*b* and movable damper 13*a* with a strong pressure. The second sheet bundle thickness detection sensor St2 and gripping sensor Sg are provided on the movable damper 13*a*; the second bundle-thickness detection means St2 detects the sheet bundle thickness. (St08) These detection values are used to set control conditions such as the amount of adhesive to apply using the adhesive application means 20, the coversheet setting position of the coversheet conveyance means 30, the idle position of the cover binding means 40, and the trimming blade idle position of the trimming means 50 and the like.

Changing Bundle Orientation

At the same time as the second sheet bundle thickness detection, the bookbinding control unit 65 receives the gripping end signal from the gripping end sensor Sg, then rotatingly drives the turning motor Mb to turn the sheet bundle substantially 90°. Then, the inner-leaf sheets handed over in a horizontal orientation from the inner-leaf tray 2 are turned substantially vertically to be conveyed along the bookbinding path 5 which is also vertically oriented.

Setting Application Position of Inner-Leaf Sheets

The bookbinding control unit 65 conveys the inner-leaf sheets and sets them at a predetermined adhesive application position using the elevator motor Mc of the inner-leaf conveyance means 10. (St09). At that time, the bookbinding control unit 65 varies the speed to convey the inner-leaf sheets to the application position X using the inner-leaf conveyance means 10 according to the bundle makeup information. For that purpose, the bookbinding control unit 65, in an instance of a "mixed-sheet makeup" or a "folded-sheet makeup" that includes saddle-stitch folded sheets, compares the instance with the case of a "simple-sheet makeup" and sets the speed of the elevator motor Mc for the inner-leaf conveyance means 10 to a lower rate.

Next, the bookbinding control unit 65 is equipped with inner-leaf sheet setting position operation means that calculate a setting position of the inner-leaf sheets based on the bundle makeup information and the bundle thickness information. As described above, the inner-leaf sheet setting position operation means sets the inner-leaf sheets at the adhesive application position so that the adhesive application amount is standard when the bundle makeup of the inner-leaf sheets is (1) configured of simple sheets, and so that the application amount is greater compared to the standard amount when the bundle makeup of the inner-leaf sheets is (2) configured of mixed sheets or folded sheets. At the same time as this, this sets the inner-leaf sheets at the adhesive application position to increase or decrease the amount of adhesive to apply according to the bundle thickness detected by the second bundle thickness detection means St2. (St09)

For that reason, the inner-leaf conveyance means 10 adjusts the gap Ga (see FIG. 6) between the applicator roller 21 and edges of the sheets disposed in the adhesive application position when using the elevator motor Mc to set the inner-leaf sheets at the application position X. This position adjustment is achieved by the varying the amount of rotation of the elevator motor Mc. However, operation means are configured to calculate the amount of rotation using the bundle makeup information and sheet bundle thickness information. A data table that sets the amount of motor rotation according to the inner-leaf sheet bundle thickness for the operation means is provided on RAM76. Rotation amounts are set in this table to correspond to bundle thickness with standard and non-standard. Compared to standard, the adhesive application amount is greater for non-standard. The differences in the adhesive application amounts for standard and non-standard are determined by testing according to the adhesive properties and application temperature (viscosity). When the inner-leaf sheet bundle makeup only has simple sheets, the adhesive application amount is set to standard. For the other sheet bundle constitutions, the adhesive application amount is set to non-standard.

Coversheet Conveyance

Next, almost in tandem to setting the sheet bundle at the adhesive application position, the bookbinding control unit 65 conveys the coversheet from the coversheet tray 31 to the cover-binding location Y. (St10) For that reason, the bookbinding control unit 65 rotatingly drives the pickup means 32 of the coversheet tray 31 at a signal from the gripping end sensor Sg of the inner-leaf conveyance means 10, for example, to separate coversheets into single sheets. The coversheet is fed to the coversheet conveyance path 6 and to the aligning mechanism 35. The coversheet size that reaches the aligning mechanism 35 is detected by the coversheet length detection means SS3. In other words, the sensor detects the leading and trailing edge of the coversheet conveyed through the coversheet conveyance path 6. The time for the sheet to pass therethrough is used to calculate the length of the sheet in its direction of conveyance to detect the length of the coversheet.

Suitable Size Secondary Determination

The controller 60 recognizes the length of the coversheet using the detection signal from the length detection means of the coversheet, and determines whether the coversheet is twice the length of the coversheet input using the input means 61 (St11). In other words, the controller 60 determines whether the length of the coversheet conforms to the predetermined bookbinding process. The controller 60 prohibits application of adhesive by the adhesive application means 20 and processes a jam when the length is determined to be non-conforming at the secondary determination.

The jam process is either for the operator to remove the non-conforming coversheet that is in the coversheet conveyance path 6, or to convey it out of the unit from an ejection outlet (discharge outlet). Also, the inner-leaf sheets are conveyed out from the bookbinding path 5 to the stacker 57 by the inner-leaf conveyance means 10. At this time can be bound (top binding) by adhesive to prevent the sheet bundle from becoming in disarray.

Setting Coversheet Into Binding Location

At the determination above, when the coversheet size conforms to the bookbinding process, the bookbinding control unit 65 controls a coversheet conveyance roller 30 to convey the coversheet from the aligning mechanism 35 and sets it at the cover-binding location Y. (St12) The positioning of the coversheet at the cover-binding location is set so that the coversheet spine binding portion is positioned at the reference position shown in FIG. 8, considering the bundle thickness detected by the second bundle thickness detection means St2. In other words, the coversheet is fed to the cover-binding location Y so that the fore-edge of the coversheet is aligned after the spine is bound, according to the thickness of the sheet bundle.

Adhesive Application Operation

Figure 5B:
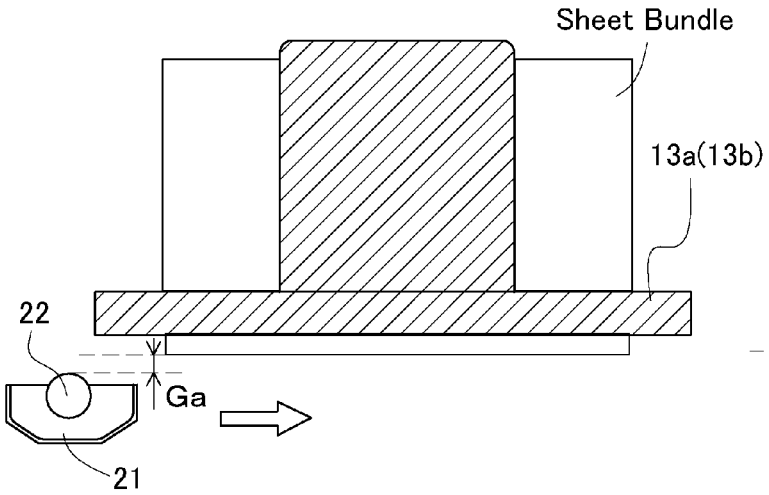
Figure 5D:
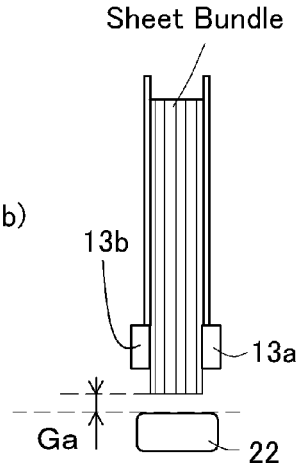

The bookbinding control unit 65 receives the signal that the coversheet is set at the cover-binding location Y, and coats the spine portion of the sheet bundle set at the adhesive application position with adhesive at step St09. (St13) The adhesive application is executed by the adhesive application means 20 reciprocating the adhesive container 21 along an edge of the sheet bundle. In other words, with the outward movement of the adhesive container 21, the edge of the sheet bundle is caused to separate (the states of FIGS. 5A and 5C) and applies adhesive in the return movement (FIGS. 5B and 5D).

Coversheet Binding Operation

Next, the bookbinding control unit 65 the inner-leaf sheets in the inner-leaf conveyance means 10 to the cover-binding location Y and touches the sheet bundle to the preset spine binding portion of the coversheet in an upside-down T shape. The coversheet at this time is supported by the spine rest plate 41 and the spine-folding press members 42 retreat from the spine folding position. In this way, after abutting and joining the inner-leaf sheets to the coversheet, the bookbinding control unit 65 moves the spine-folding press members 42 to the spine folding position. The amount of movement of the spine-folding press members is set according to the sheet bundle thickness detected by the second bundle-thickness detection means St2. The coversheet is bound to the sheet bundle at this cover-binding location Y. (St14)

Adhesive Cooling

After the coversheet is bound to the sheet bundle, the bookbinding control unit 65 waits for a predetermined cooling time to pass while pressing the coversheet against the spine rest plate 41. (St15) When the cooling time has passed, the adhesive (hot-melt adhesive) coated on the spine portion of the inner-leaf sheets hardens and forms the spine portion of the booklet. The bookbinding control unit 65 is configured to set the cooling time according to the sheet bundle makeup information. In other words, depending on the bundle makeup, the adhesive application amount is set to a standard cooling time when the sheet bundle is standard or when it is non-standard, it is set to a non-standard cooling time, the latter, non-standard cooling time set to be longer than the standard cooling time.

Trimming

After the cooling time has passed, the bookbinding control unit 65 feeds the sheet bundle encased in the coversheet to the downstream folding rollers 45 where they fold the coversheet to completely fold the coversheet. The trimming means 50 is disposed downstream of the folding rollers 45. At the trimming position Z, the trimming means trims true three sides of the sheet bundle, excluding the spine portion. (St16) The swivel tables 47*a*, 47*b* change the orientation of the sheet bundle so that the trimming means 50 can trip the top, bottom and fore-edge portions in that order. At this time, the bookbinding control unit 65 changes the speed of the movement of the trimming blade 54 based on the bundle makeup information of the inner-leaf sheets. In other words, if the sheet bundle is composed of simple sheets the speed is high, and if the sheet bundle is composed of folded sheets, the speed is low.

Stacking Storage Operation

The bookbinding control unit 65 feeds the sheet bundle to the discharge roller when the trimming process is completed and stores the sheet bundle in the stacker 57 (St17).

As described above, the present invention positions the first bundle-thickness detection means St1 in the inner-leaf tray 2, and the second sheet bundle thickness detection sensor St2 in the gripping conveyance means 10 that conveys the inner sheets downstream of that tray. Furthermore, the control means 65P of the bookbinding control unit 65 determines (St05 described above) whether the inner sheets have been conveyed to the gripping conveyance means 10 from the inner-leaf tray 2 based on detection information from the first bundle-thickness detection means St1. The adhesive application amount using the adhesive application means 20, the setting position of the coversheet at the binding position X using the coversheet conveyance means 30, the spine folding position using the cover binding means 40, the movement amount of the trimming blade 54 using the trimming means 50 are each set based on detection information from the second bundle-thickness detection means St2.

Because the first bundle-thickness detection means St1 determines whether the inner sheets set on the tray exceed the predetermined thickness, it is possible to make a rough setting for the detection accuracy of the sheet bundle thickness by setting a margin (determination error) in the determination. For that reason, it is possible to adopt a good and simple detection structure for the first bundle-thickness detection means St1 by touching the sheet contact arm 3*a*, not shown, to the uppermost sheet using its own weight or an urging spring 3*c*. That position can be detected using a Slidac sensor. Therefore, users will not get their fingers pinched when setting inner sheets in the inner-leaf tray 2. This also does not invite failure of the unit caused by foreign matter from entering into the unit at the same time as the sheets.

Also, the second bundle-thickness detection means St2 adopts a structure to accurately detect the sheet bundle thickness by strongly clamping the sheet bundle when nipping the sheets being conveyed into the unit from the inner-leaf tray 2 using the movable damper 13*a* and the fixed damper 13*b*, for example. This makes it possible to set the control conditions necessary for the appropriate bookbinding process such as the adhesive application amount setting, the setting position of the coversheet, and the moving stroke of the trimming blade.

The present application claims priority from Japanese Pat. App. No. 2007-244304, which is herein incorporated by reference.

What is claimed is:

1. A bookbinding unit for encasing in coversheets and forming into booklets inner-leaf sheets collated into bundles, the bookbinding unit comprising:

an inner-leaf tray on which inner-leaf sheets are set into a bundle;

a cover tray on which coversheets are set;

a bookbinding process path for transporting sheet bundles from said inner-leaf tray to, in order, an adhesive application location and a cover-binding location;

gripping conveyance means for gripping sheet bundles from said inner-leaf tray and transferring them along said bookbinding process path;

coversheet conveyance means for feeding coversheets from said cover tray and setting them into place in the cover-binding location;

adhesive application means, disposed in the adhesive application location, for applying adhesive to a spine-portion endface of inner-leaf sheets;

cover binding means, disposed in the cover-binding location, for binding inner-leaf sheets together with coversheets; and bookbinding operation control means for processing inner-leaf sheets with coversheets to form booklets; wherein a first sheet bundle-thickness detection means is disposed in said inner-leaf tray, for detecting bundle thickness of a bundle of sheets stacked therein;

a second sheet bundle-thickness detection means is disposed in said gripping conveyance means, for detecting thickness of a bundle of gripped inner-leaf sheets; and said bookbinding operation control means is configured to prohibit the operation by said gripping conveyance means whereby sheet bundles are conveyed out from said inner-leaf tray, if the thickness of an inner-leaf sheet bundle detected by said first sheet bundle-thickness detection means is more than a predetermined thickness, and control said adhesive application means and/or coversheet conveyance means based on bundle-thickness information from said second bundle-thickness detection means.

2. The bookbinding unit according to claim 1, wherein the bookbinding operation control means is configured so as, in prohibiting the operation by said gripping conveyance means whereby sheet bundles are conveyed out from said inner-leaf tray, to determine whether the bundle thickness detected by said first bundle-thickness detection means is more than the maximum permitted thickness that can be conveyed by said gripping conveyance means.

3. The bookbinding unit according to claim 1, further comprising:

trimming means, disposed downstream of said cover binding means, for trimming into alignment peripheral edges of a cover-bound sheet bundle; wherein said bookbinding operation control means regulates the trimming speed of, and/or the amount of trimming-blade travel in, said trimming means, based on bundle thickness information from said second bundle-thickness detection means.

4. The bookbinding unit according to claim 1, wherein said bookbinding operation control means is furnished with coversheet-position computing means for calculating setting position into which coversheets fed to the coversheet binding location by said coversheet conveyance means are set, based on bundle-thickness information from said second bundle-thickness detection means.

5. The bookbinding unit according to claim 1, wherein said bookbinding operation control means controls said adhesive application means and/or said gripping conveyance means so as to modulate, based on bundle thickness information from said second bundle-thickness detection means, the amount of adhesive applied by said adhesive application means.

6. The bookbinding unit according to claim 1, wherein said first bundle-thickness detection means is constituted by a sheet contact arm for abutting on the uppermost sheet stacked in said inner-leaf tray, and a sensor for detecting the amount of sheet-contact-arm travel.

* * * * *